US009513074B1

(12) United States Patent
Steil

(10) Patent No.: US 9,513,074 B1
(45) Date of Patent: Dec. 6, 2016

(54) FIREARM WITH INTERCHANGEABLE PARTS

(71) Applicant: Everett McDowell Steil, Cumming, GA (US)

(72) Inventor: Everett McDowell Steil, Cumming, GA (US)

( * ) Notice: Subject to any disclaimer, the term of this patent is extended or adjusted under 35 U.S.C. 154(b) by 0 days.

(21) Appl. No.: 14/955,114

(22) Filed: Dec. 1, 2015

Related U.S. Application Data

(60) Provisional application No. 62/169,136, filed on Jun. 1, 2015.

(51) Int. Cl.

| | |
|---|---|
| ***F41A 3/64*** | (2006.01) |
| ***F41A 3/66*** | (2006.01) |
| ***F41A 5/18*** | (2006.01) |
| ***F41A 21/00*** | (2006.01) |
| ***F41A 3/72*** | (2006.01) |
| ***F41A 15/16*** | (2006.01) |
| ***F41C 23/16*** | (2006.01) |
| ***F41G 1/02*** | (2006.01) |
| ***F41A 9/64*** | (2006.01) |

(52) U.S. Cl.
CPC .. *F41A 5/18* (2013.01); *F41A 3/66* (2013.01); *F41A 3/72* (2013.01); *F41A 9/64* (2013.01); *F41A 15/16* (2013.01); *F41A 21/00* (2013.01); *F41C 23/16* (2013.01); *F41G 1/02* (2013.01)

(58) Field of Classification Search
CPC ..... F41A 3/64; F41A 3/66; F41A 3/14; F41A 5/26; F41A 5/28; F41A 5/30; F41A 11/00; F41A 11/02; F41A 21/48; F41A 21/481; F41A 21/482
See application file for complete search history.

(56) References Cited

U.S. PATENT DOCUMENTS

| | | | | | |
|---|---|---|---|---|---|
| 1,014,660 | A * | 1/1912 | Mauser | F41A 3/66 | 89/125 |
| 1,359,608 | A * | 11/1920 | Lang | F41A 3/40 | 42/75.02 |
| 1,572,450 | A * | 2/1926 | Swebilius | F41A 3/40 | 42/75.03 |
| 1,907,164 | A * | 5/1933 | White | F41A 3/32 | 42/16 |
| 2,093,169 | A * | 9/1937 | Holek | F41A 3/32 | 42/18 |
| 2,455,644 | A * | 12/1948 | Barnes | F41A 3/66 | 42/2 |
| 2,503,596 | A * | 4/1950 | Rataiczak | F41A 3/66 | 89/125 |
| 2,554,618 | A * | 5/1951 | Dixon | F41A 3/40 | 89/193 |
| 2,926,445 | A * | 3/1960 | Green | F41A 3/66 | 42/17 |
| 2,981,154 | A * | 4/1961 | Sweeney | F41A 21/481 | 42/75.02 |
| 2,983,196 | A * | 5/1961 | Dixon | F41A 5/26 | 89/191.01 |
| 3,336,691 | A * | 8/1967 | Allyn | F41A 3/32 | 42/16 |
| 3,386,336 | A * | 6/1968 | Roy | F41A 3/72 | 42/75.02 |

(Continued)

*Primary Examiner* — Bret Hayes
*Assistant Examiner* — Derrick Morgan
(74) *Attorney, Agent, or Firm* — Merchant & Gould P.C.

(57) ABSTRACT

A modernized firearm including interchangeable features.

20 Claims, 23 Drawing Sheets

(56) References Cited

U.S. PATENT DOCUMENTS 3,512,290 A * 5/1970 La Violette, Jr. ..... F41A 3/66 42/75.01
5,155,292 A * 10/1992 Rostcil ..... F41A 3/82 89/167
5,522,166 A * 6/1996 Martel ..... F41G 11/003 42/124
5,900,577 A * 5/1999 Robinson ..... F41A 11/02 89/156
7,735,409 B1 * 6/2010 Tertin ..... F41A 3/72 42/69.02
7,802,392 B2 * 9/2010 Peterson ..... F41A 11/02 42/124
7,905,041 B1 * 3/2011 Davies ..... F41A 3/66 42/75.02
8,205,373 B1 * 6/2012 Ubl ..... F41C 23/16 42/71.01
8,215,221 B2 * 7/2012 Lawitzke ..... F41A 21/481 42/76.01
8,464,453 B1 * 6/2013 Ubl ..... F41A 3/36 42/15
8,756,846 B1 * 6/2014 Lemoine ..... F41A 3/66 42/69.01
8,931,196 B1 * 1/2015 Larue ..... F41A 11/04 42/71.01
9,068,801 B1 * 6/2015 Stecher, Jr. ..... F41G 11/00
9,310,160 B1 * 4/2016 DiChario ..... F41C 23/10
2002/0116857 A1 * 8/2002 Wonisch ..... F41A 3/64 42/75.02
2004/0244258 A1 * 12/2004 O'Dwyer ..... F41A 9/35 42/77
2008/0168695 A1 * 7/2008 Nakayama ..... F41A 21/481 42/75.02
2008/0190005 A1 * 8/2008 Rohrauer ..... F41A 3/66 42/75.01
2008/0216375 A1 * 9/2008 Barrett ..... F41A 3/66 42/16
2009/0320673 A1 * 12/2009 Lawitzke ..... F41A 21/481 89/14.7
2010/0300278 A1 * 12/2010 Zedrosser ..... F41A 3/26 89/180
2011/0306019 A1 * 12/2011 Landies ..... F41A 33/00 434/16
2012/0137563 A1 * 6/2012 Ubl ..... F41C 23/16 42/75.03
2012/0144985 A1 * 6/2012 Beville ..... F41A 3/26 89/9
2012/0180354 A1 * 7/2012 Sullivan ..... F41A 3/26 42/16
2013/0047833 A1 * 2/2013 Steimke ..... F41A 5/26 89/191.01
2013/0174457 A1 * 7/2013 Gangl ..... F41A 3/72 42/16
2013/0205637 A1 * 8/2013 Patel ..... F41A 3/66 42/75.02
2014/0000142 A1 * 1/2014 Patel ..... F41C 23/16 42/14
2014/0068987 A1 * 3/2014 Burt ..... F41C 23/16 42/16
2014/0224114 A1 * 8/2014 Faxon ..... F41A 15/14 89/193
2015/0059221 A1 * 3/2015 Bero ..... F41A 3/66 42/16
2015/0330734 A1 * 11/2015 Kolev ..... F41A 3/12 42/69.01
2015/0354910 A1 * 12/2015 Kerbrat ..... F41A 3/64 42/16
2016/0010932 A1 * 1/2016 Leimer ..... F41A 5/26 89/193
2016/0033218 A1 * 2/2016 Folkestad, II ..... F41A 3/66 89/194
2016/0033219 A1 * 2/2016 Meier ..... F41A 3/66 89/191.01
2016/0047611 A1 * 2/2016 Battaglia ..... F41A 3/14 42/16
2016/0178297 A1 * 6/2016 Sharps ..... F41A 3/66 42/14
2016/0195350 A1 * 7/2016 Packard ..... F41A 3/66 42/6

* cited by examiner

FIREARM WITH INTERCHANGEABLE PARTS

CROSS-REFERENCE TO RELATED APPLICATIONS

This application claims the benefit of priority to U.S. Provisional Patent Application No. 62/169,136 filed Jun. 1, 2015, the disclosure of which is hereby incorporated by reference in its entirety.

BACKGROUND

Modern firearms present many advantages over their outdated and, in many instances, obsolete predecessors. However, outdated or "legacy" firearms still hold appeal for many reasons, such as their methods of operation and their look and feel. Thus there is a need for modernized legacy firearms that maintain recognizable utilitarian and/or aesthetic features of a legacy firearm.

SUMMARY

The present disclosure relates generally to a new firearm comprising a plurality of legacy components as well as one or more features that enable interchangeability of firearm components.

In one aspect, a firearm comprises a barrel, a barrel nut, and a trunnion mated with a receiver, the barrel nut and barrel being removably coupled to the receiver, wherein the outer surface of the trunnion on each of the left side and the right side comprises a conical depression, two parallel vertically oriented elongated recesses disposed towards the front face of the trunnion and extending upwardly from the bottom of the trunnion, and a horizontally oriented elongated recess disposed behind the two vertically oriented elongated recesses and above the conical depression, the horizontally oriented elongated recess extending forwardly from the rear face of the trunnion, and wherein one or more components of the firearm is/are configured to be swapped with components of another model firearm.

In another aspect, a firearm comprises a bolt block comprising a set screw for adjusting the position of the bolt block and a trunnion, wherein the outer surface of the trunnion on each of the left side and the right side comprises a conical depression, two parallel vertically oriented elongated recesses disposed towards the front face of the trunnion and extending upwardly from the bottom of the trunnion, and a horizontally oriented elongated recess disposed behind the two vertically oriented elongated recesses and above the conical depression, the horizontally oriented elongated recess extending forwardly from the rear face of the trunnion.

In a further aspect, a firearm comprises a magazine retention block disposed below a trunnion, wherein the outer surface of the trunnion on each of the left side and the right side comprises a conical depression, two parallel vertically oriented elongated recesses disposed towards the front face of the trunnion and extending upwardly from the bottom of the trunnion, and a horizontally oriented elongated recess disposed behind the two vertically oriented elongated recesses and above the conical depression, the horizontally oriented elongated recess extending forwardly from the rear face of the trunnion.

DETAILED DESCRIPTION

Figure 1A:
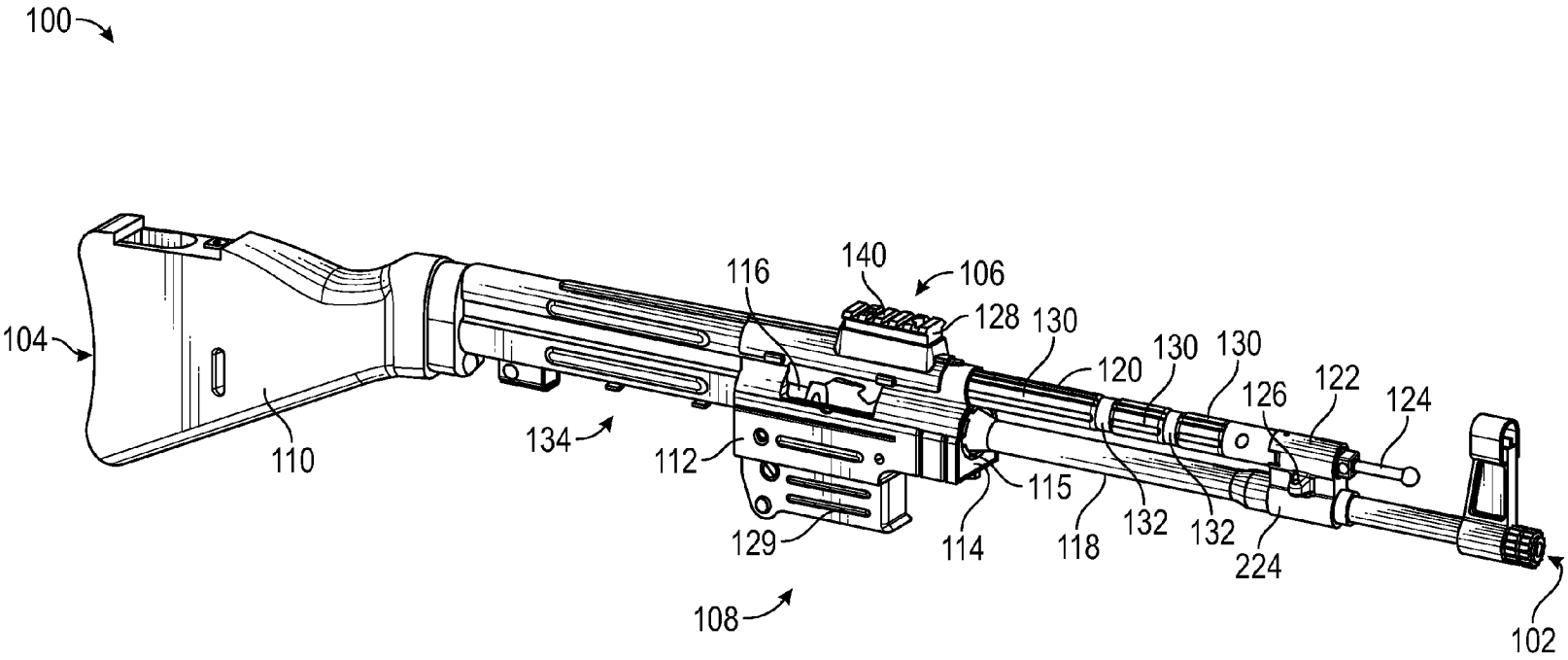
FIG. 1A is a perspective view of a portion of an example firearm in accordance with one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The present disclosure relates generally to a firearm comprising a plurality of legacy features and a plurality of modern features. This disclosure is not limited to firearm features from any particular legacy firearm or firearms, nor to firearm features from any particular modern firearm or firearms. However, for ease of illustration, the legacy features shown in the accompanying drawings are associated with one or more versions of a World War II era assault rifle known as the Sturmgewehr (hereinafter referred to as "STG"). In addition to being visually recognizable today as STG features, these features were incorporated for utilitarian reasons in the STG, for example to reduce weight, increase durability, and/or improve reliability in STG firearms. It should be noted that the figures may show additional STG features that are not described below.

Figure 1B:
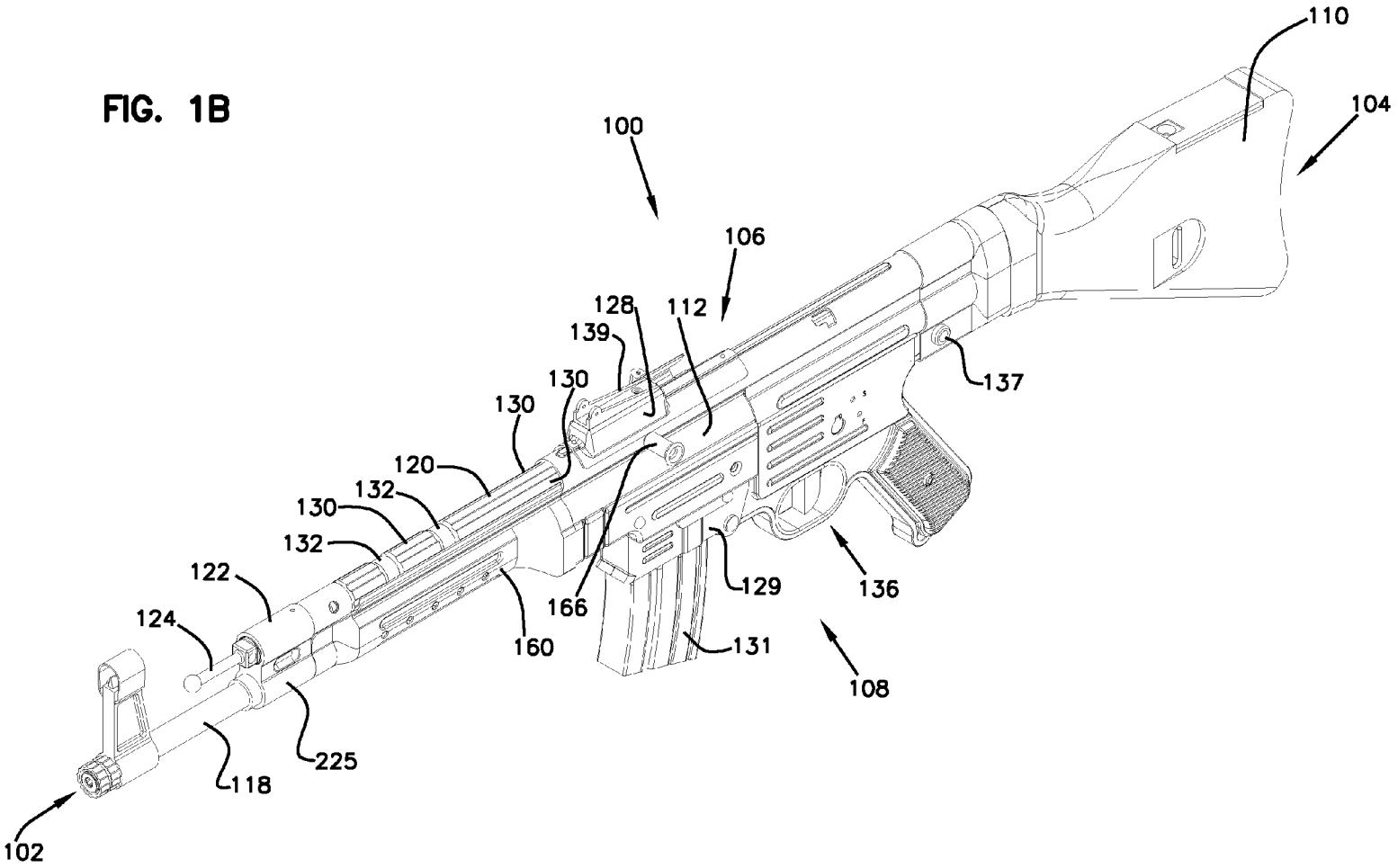
FIG. 1B is a perspective view of a further portion of an example firearm in accordance with the embodiment of FIG. 1A.

FIG. 1A is a perspective view of a portion of an example firearm 100 in accordance with one embodiment of the present disclosure. FIG. 1B is a perspective view of a further portion of an example firearm 100 in accordance with the embodiment of FIG. 1A. With reference to FIGS. 1A-1B, the firearm 100 includes a front 102, a back 104, a top 106, a bottom 108, a buttstock 110, a receiver 112, a trunnion 114, a barrel nut 115, an ejector port 116, a barrel 118, a gas tube 120, a gas block 122 having a right side 224 and a left side 225, a stacking post 124, a sling loop 126, a sight mount 128, a magazine holder 129 for holding a magazine 131 of ammunition. With reference to FIG. 1B, the firearm 100 includes a handgrip 160 and a charging handle 166. The gas tube 120 includes a plurality of ridges 130 and a plurality of waists 132. The firearm 100 also includes a trigger coupling area 134 for attaching a trigger assembly 136.

In some examples, the firearm 100 is a semi-automatic tilting bolt rifle. The firearm 100 is defined by the front 102, the back 104, the top 106 and the bottom 108. Throughout this disclosure, references to orientation (e.g., front(ward), rear(ward), in front, behind, above, below, high, low, back, top, bottom, under, underside, etc.) of structural components shall be defined by that component's positioning in FIG. 1A relative to, as applicable, the front 102, the back 104, the top 106, and the bottom 108 of the firearm 100, regardless of how the firearm 100 may be held and regardless of how that component may be situated on its own (i.e., separated from the firearm 100).

In general terms, the buttstock 110 is at the back 104 of the firearm 100 and rests against the body of the shooter while firing the firearm 100. The buttstock 110 helps to support the firearm 100 while firing one or more rounds of ammunition, and can also function to transfer recoil force generated from the exploding gases associated with firing a round, thereby reducing some of the drawbacks of recoil, such as barrel kick. In this example, the buttstock 110 is shaped like a STG buttstock and is made of wood, as in the STG. In other examples, the buttstock 110 is made of different materials and/or shaped differently to resemble a firearm other than an STG. In alternative examples the buttstock 110 can be a pistol variant, AR compatible stock or a folding stock. The buttstock 110 can be removed/substituted by removing a rear take down pin 137 (FIG. 1B) disposed in the buttstock 110 and exchanging the buttstock thereby.

The receiver 112 holds the trunnion 114 from which the barrel 118 extends forwards. The trunnion aligns various components within the receiver 112 on the one hand, and the barrel 118 on the other hand, securely maintaining the relative positioning of the various moving and stationary parts while firing the firearm 100. The trunnion 114 has various features exclusively in common with the STG trunnion, which will be discussed below. However, unlike the STG trunnion, the trunnion 114 is configured to accommodate one or more of the following: multiple trigger assemblies 136 (e.g. semi-automatic, automatic, manual), different barrels (e.g. different lengths, calibers, and so forth), different bolt assemblies, different bolts, different ammunition calibers, and so forth.

Similarly, because the barrel 118 is interchangeable with other barrels, components coupled to the barrel, directly or indirectly (i.e., parts of a barrel assembly) are also interchangeable with corresponding components from other model firearms, including but not limited to the gas tube 120, the gas block 122, the gas piston partially housed within the gas tube 120 (discussed below), a charging handle, hand grips, scopes, sights or mounts that are mounted to the barrel and/or the gas tube, and so forth.

In some examples, a barrel extension couples the barrel 118 to the trunnion 114, enabling interchangeability of one or more parts of the barrel assembly; in other examples, the trunnion 114 is configured to removably couple directly to the barrel 118. Removable coupling of the trunnion 114 and the barrel 118 can be accomplished with the barrel nut 115, which is itself removably secured (via screw threads) to the trunnion 114. The STG trunnion and barrel assembly are pinned in place and essentially permanent fixtures of the STG that are not interchangeable. In contrast, the firearm 100 uses a barrel nut 115 to keep the barrel assembly in place on the trunnion 114. Thus, the barrel nut 115 allows the firearm 100 to have interchangeable barrels, which in turn allows for end user customization (e.g., by modifying the dimensions and characteristics of the barrel nut 115) as well as permitting the use of different calibers in the same receiver by swapping barrel assemblies. In some examples, the firearm 100 includes a barrel 118 identical to a model AR-15 platform barrel. In other examples the barrel 118 is a different model barrel, including but not limited to a pistol barrel and a carbine barrel.

The ejector port 116 is a window in the receiver through which spent ammunition cartridge casings are discharged during a firing cycle. In some examples a pivotal flap, hinged either below or above the ejector port 116, can block the ejector port 116 and prevent unwanted dust and other debris from entering the receiver while the firearm 100 is not being used. The barrel 118 has an interior bore through which a projectile travels when the firearm is fired, and ultimately exits the front of the barrel 118 travelling towards a target. The gas tube 120 contains a spring biased gas piston powered by fast moving gas that has been redirected from the barrel 118 during a firing cycle by the gas block 122. The redirected gas travels rearwards down the gas tube 120, causing rearward movement of the gas piston against the spring bias. The rearwards movement of the gas piston causes the gas piston to engage a bolt carrier at the forward end of a bolt assembly (partially contained within the receiver 112), and push the bolt assembly rearwards, which in turn engages the trigger assembly 136 (FIG. 1B), causing the trigger assembly to reset into a position capable of firing another round (e.g., for repeat fire). Rearward motion of the bolt assembly can also result in automatic ejection of the spent cartridge casing through the ejector port 116, and the automatic loading of a new cartridge into a chamber from a magazine. The gas piston then reciprocates forward on the bias of the spring. In some examples, the bolt assembly is slidably disposed in the trunnion 114 within the receiver 112 for axially reciprocating recoil movement therein during the firing cycle sequence of the firearm 100. The trigger assembly 136 typically includes a spring-biased hammer that is cocked and then released by a sear upon actuating a triggering mechanism. The hammer strikes a firing pin carried by the bolt of the bolt assembly, which in turn is thrust forward to contact and discharge a cartridge loaded in the chamber.

The gas tube 120 includes features from the STG, including but not limited to the ridges 130 and the waists 132. The ridges 130 run longitudinally along at least a portion of the outer surface of the gas tube 120. The waists 132 are ridge-less depressed rings in the exterior surface of the gas tube 120 that are transverse to the ridges 130 and can reduce the overall weight of the firearm 100. As shown in FIG. 1, the ridges 130 are disposed behind, between, and in front of the waists 132 on the gas tube 120. In some examples, a handgrip 160 (FIG. 1B; discussed below) is coupled to the firearm 100 by mating one or more grooves in the handgrip with ridges 130 on the gas tube 120 (e.g., by a frictional male-female fit), as was done on the STG. Unlike the STG, in the firearm 100 hand grips can be modified or swapped out to cooperate with alternative barrel assemblies (e.g., barrel assemblies containing longer or shorter barrels, or thicker or thinner barrels).

The interchangeability of the various barrel assembly components of the firearm 100 further allows for gas tubes of different lengths (e.g., mid-length, carbine length, pistol length) to be substituted for the gas tube 120. In some examples, the user of the firearm 100 can remove the gas tube 120 and shorten it, e.g., with a hacksaw.

The stacking post 124 is a STG feature that enables storage of multiple firearms by stacking multiple firearms on the ground, e.g., in a cone or pyramid-type formation. In some examples, unlike the STG stack post, the stacking post 124 is removable and/or replaceable. For example, the stacking post 124 may optionally include a rear mounting portion for removably mounting (e.g., by screwing and unscrewing) in/to a complementary mounting portion in the front of the gas block 122.

In some examples, the gas block 122 is removable from the barrel assembly by two set screws that mate to corresponding detents in the barrel 118. This allows the same user to have multiple (i.e., different) barrels and one gas block for their firearm 100.

The sling loop 126 (FIG. 1A) extends from the side (in this example, the right side 224) of the gas block 122. The sling loop 126 is configured for coupling to the end of a sling used to carry the firearm 100 around, e.g., a person's shoulders. The positioning of the sling loop 126 on the gas block 122 exists in the STG as well. In some examples, unlike the STG, the sling loop 126 is removable.

The sight mount 128 is mounted to the top of the receiver 112. Unlike the STG the sight mount 128 is removable, allowing interchanging between different mounts and sights from different model firearms. The sight mount 128 includes a mounting means such as mounting ribs. Such mounting ribs can be standard dimension such as a "Picatinny" style mounting platform (shown at 140 in FIG. 1A), also known as MIL-STD-1913, for facilitating mounting and interchanging of sights on the sight mount 128. An alternative mounting platform 139 is shown in FIG. 1B.

The trigger coupling area 134 (FIG. 1A) is an area of the firearm 100 to which any of a variety (e.g., semi-automatic, automatic, etc.) of trigger assemblies (e.g., trigger assembly 136 shown in FIG. 1B) may be installed, replaced, and/or substituted in the firearm 100. In some examples the design of the housing for a trigger assembly coupled to the trigger coupling area 134 is identical or similar to that of the STG, while requiring fewer operating components (e.g., pivot pins, locating studs and/or clockwork parts) in order to function, as available in modern trigger mechanisms.

Figure 2:
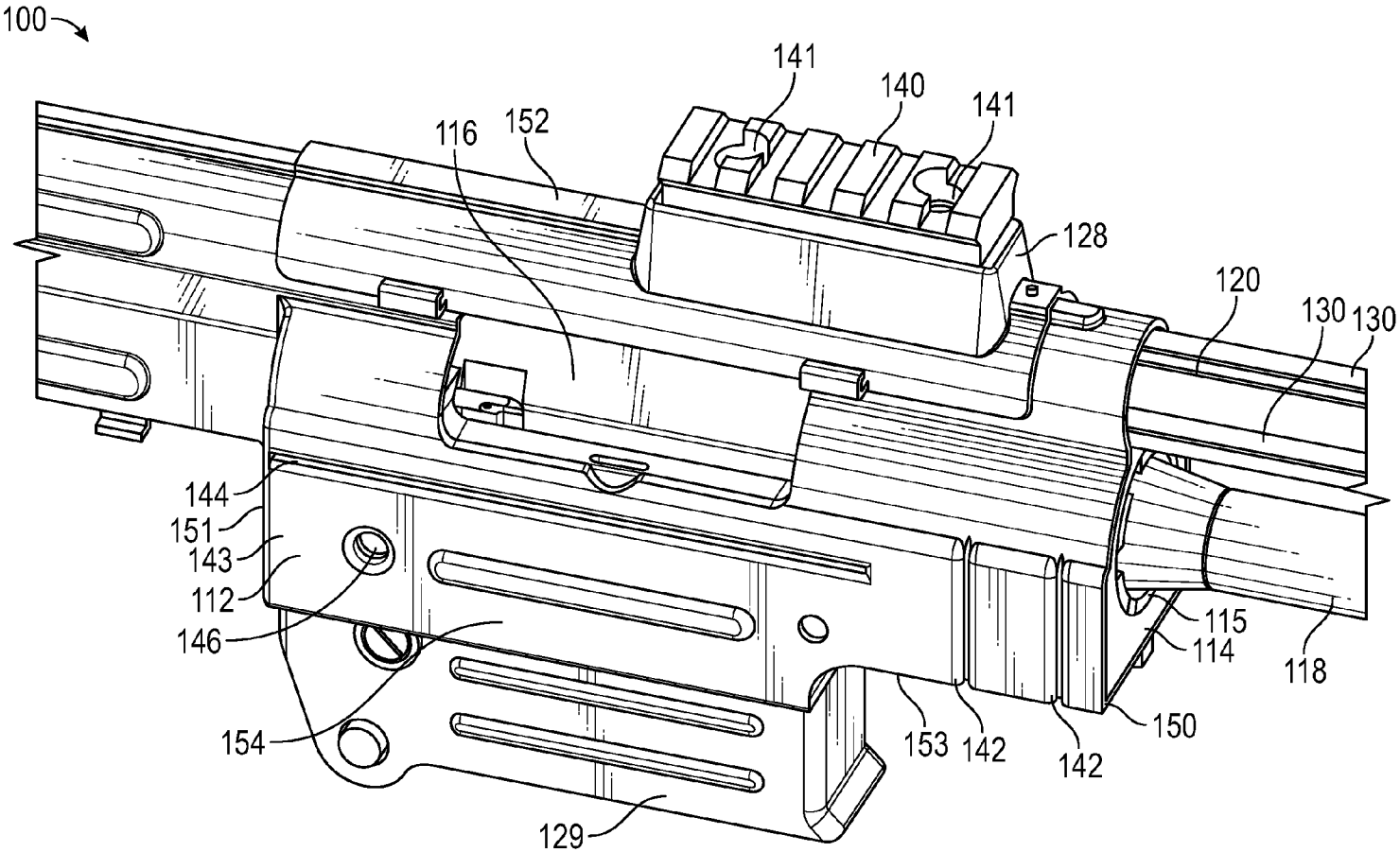
FIG. 2 is a perspective view of a first portion of the firearm of FIG. 1.

FIG. 2 is a perspective view of a first portion of the firearm 100 of FIG. 1. In FIG. 2, the firearm 100 includes the receiver 112, the trunnion 114, the barrel nut 115, the ejector port 116, the barrel 118, the gas tube 120, the sight mount 128, the magazine holder 129, and the ridges 130, as discussed above. In addition, in this example the rear sight mount includes mounting ribs 140 (discussed above), mounting means (e.g., screws) 141 elongated for removably mounting the mounting ribs 140 to the receiver 112, and the receiver 112 has an external surface 143 wherein the receiver comprises an inner cavity at least partially filled by the trunnion 114, the external surface 143 of the receiver 112 having a front end 150, a rear end 151, a top 152, a bottom 153, a right side 154, and a left side opposite the right side 154. On the right side 154 are disposed two vertically oriented elongated recesses 142 toward the front end 150 of the receiver 112 and extending upwardly from the bottom 153 of the receiver 112, one horizontally oriented elongated recess 144 behind the vertically oriented elongated recess 142 and extending forwardly from the rear end 151 of the receiver 112, and a conical depression 146 behind the vertically oriented elongated recesses 142 and below the horizontally oriented elongated recess 144. In some examples, additional features corresponding to one or more of the vertically oriented elongated recesses 142, the horizontally oriented elongated recess 144, and the conical depression 146 is/are disposed on the opposite side as that shown in FIG. 2 (i.e., the right side) of the receiver 112 as well. The geometric configuration of the conical depression 146 in relation to the vertically oriented elongated recesses 142 and the horizontally oriented elongated recesses 144 is a byproduct of pressing the sheet metal of the trunnion 114 together with the receiver 112, and provides for an extremely strong, effectively irreversible attachment of the receiver 112 and the trunnion 114.

The vertically oriented elongated recesses 142, the horizontally oriented elongated recess 144, and the conical depression 146 are STG features that are the result of permanently mating the trunnion to the receiver by pressing the sheet metal of the receiver into the various recesses and grooves on the outer surface of the trunnion (which are themselves cast or machined). It should be noted that although example firearms of the present disclosure include one or more of these STG features, the actual means by which the trunnion 114 and the receiver 112 are permanently mated need not be the same as the STG. Attaching the receiver 112 and the trunnion 114 will be discussed in more detail below. For example, the firearm 100 may include the vertically oriented elongated recesses 142, the horizontally oriented elongated recess 144, and the conical depression 146 even though the trunnion 114 and the receiver 112 are mated to each other through means other than pressing sheet metal (e.g. rivets, pins, screws, soldering, welding etc.).

Figure 3:
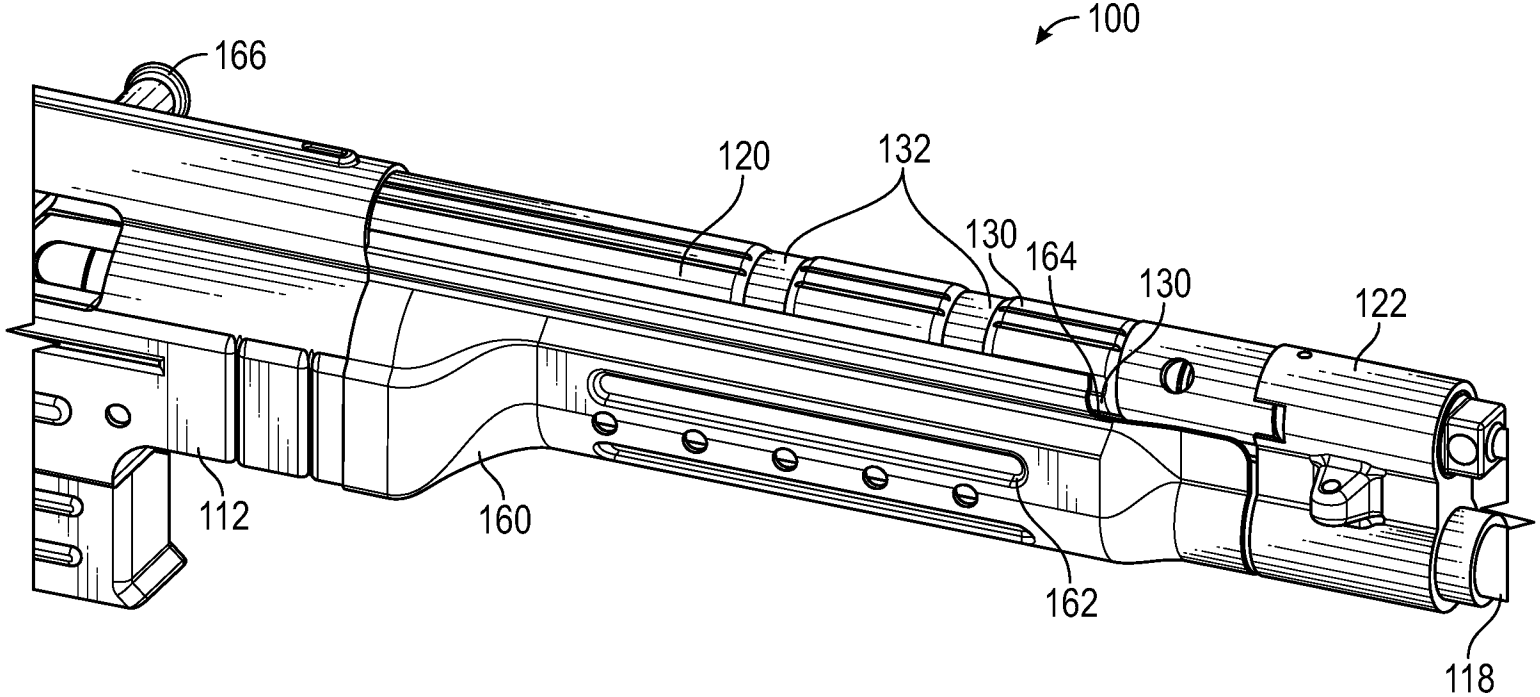
FIG. 3 is a perspective view of a second portion of the firearm of FIG. 1 including a mounted example handgrip.

FIG. 3 is a perspective view of a second portion of the firearm 100 of FIG. 1 including a mounted example handgrip 160. The example firearm 100 includes a receiver 112, a barrel 118, a gas tube 120, a gas block 122, ridges 130, and waists 132 as discussed above. In addition, in this example, the firearm 100 includes a handgrip 160 having a gripping portion 162 and a mating groove 164, and the firearm 100 includes a charging handle 166.

The gripping portion 162 of the handgrip 160 provides a place for the shooter to conveniently and safely hold the front part of the firearm 100 without, e.g., getting burned by the barrel 118. In this example, the external appearance of the handgrip 160 resembles a STG handgrip. However, the handgrip 160 can be interchanged with one or more different handgrips to mount to and cooperate with different barrel assemblies, gas tubes, and so forth. The groove 164 on either side of the handgrip 160 mates with a ridge 130 on the gas tube 120 in order to couple the handgrip 160 to the firearm 100, as in the STG. The charging handle 166 allows for manual reset of the trigger mechanism and bolt assembly by pulling rearwards on the charging handle. Pulling rearwards on the charging handle has the same effect as pressurized gas in the gas tube 120 pushing the gas piston rearwards if, e.g., the automatic reset fails. In some examples the configuration of the charging handle 166 is consistent with the STG charging handle. In alternative examples, however the charging handle 166 is coupled to the gas piston rather than the bolt carrier (as in the STG), allowing for easier removal, replacement, and/or substitution of the charging handle 166 (e.g. by replacing the gas piston only, rather than replacing the entirety or a portion of the bolt assembly in conjunction with the gas piston).

Figure 4A:
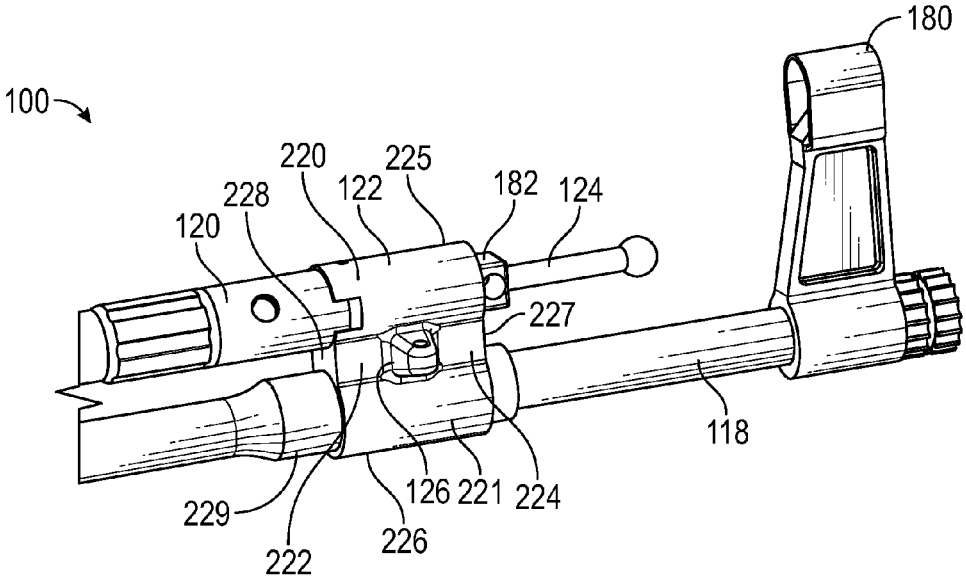
FIG. 4A is a perspective view of a third portion of the firearm of FIG. 1.
Figure 4B:
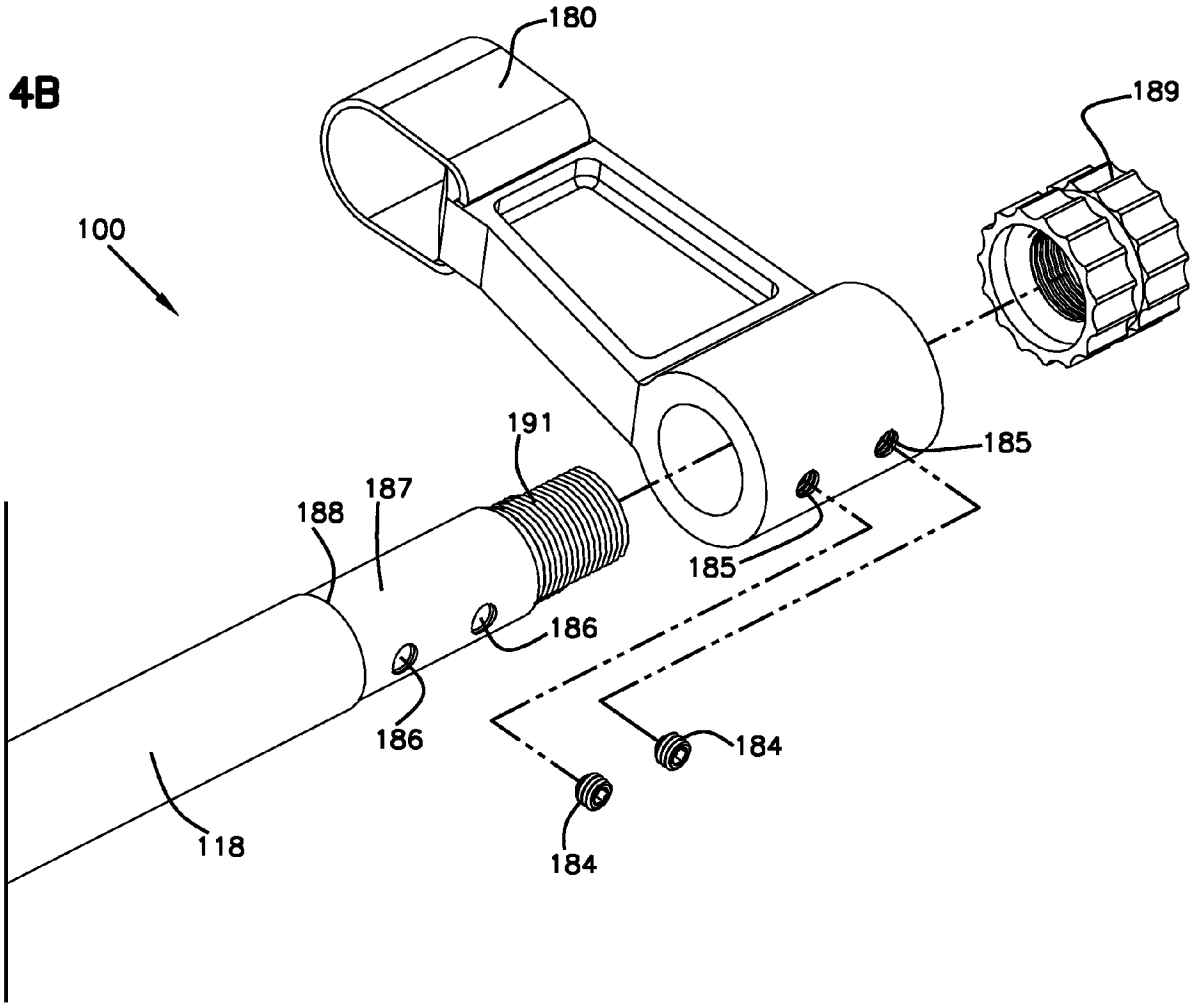
FIG. 4B is a bottom perspective exploded view of a front side portion of FIG. 4A.

FIG. 4A is a perspective view of a third portion of the firearm 100 of FIG. 1; FIG. 4B is a bottom perspective exploded view of a portion of the front sight portion of FIG. 4A. The firearm 100 includes the barrel 118, the gas tube 120, the gas block 122, the stacking post 124, and the sling loop 126 as discussed above. In addition, in this example the firearm 100 includes a front sight assembly 180, and the stacking post 124 includes a mounting portion 182. In some examples, the mounting portion 182 allows the stacking post 124 to be removed, replaced, and/or substituted from the gas block 122, as discussed above (e.g., by screwing the mounting portion 182 into or out of the gas block 122 via screw threads).

Although in this example the front sight assembly 180 looks externally like its STG counterpart, in some examples, unlike the STG, the front sight assembly 180 can be adjusted for windage (left to right), allowing the user to properly "zero" their rifle. As shown in the example in FIG. 4B, the front sight assembly 180 includes two set screws 184 that are removably coupled to corresponding holes 185 and 186 in the bottom of the front sight assembly 180 and the bottom of the barrel 118, respectively, the holes 186 being disposed in a recessed area 187 of the barrel 118. The recessed area 187 provides a shoulder 188 against which the front sight assembly 180 rests, reducing the possibility of rearward slippage of the front sight assembly 180 along the barrel 118. Adjusting the set screws 184 allows for adjustments of the front sight assembly 180 to account for windage. This functionality is not available on the STG. A muzzle 189 removably secured to the screw threads 191 disposed at the forward end of the barrel 118 forwardly secures the front sight assembly 180 to the firearm 100.

Referring to FIG. 4A, the gas block 122 shown in FIG. 4 includes the right side 224 as discussed above. In addition, in this example, the gas block 122 includes an upper portion 220, a lower portion 221, a waist 222 disposed between the upper portion 220 and the lower portion 221, a top 225, a bottom 226, a front 227, and a back 228. The sling loop 127 extends from the right side 224 of the waist 222. The back 228 of the upper portion 220 removably mates with the front end of the gas tube 120. The lower portion 221 removably mates with a radially expanded section 229 of the barrel 118, and the gas block 122 and the barrel 118 are attached (unlike the STG) via one or more set screws on the bottom 226 of the gas block 122. The mounting portion 182 of the stacking post 124 removably mates with the gas block 122 at the front 227 of the upper portion 220 of the gas block 122.

Figure 5:
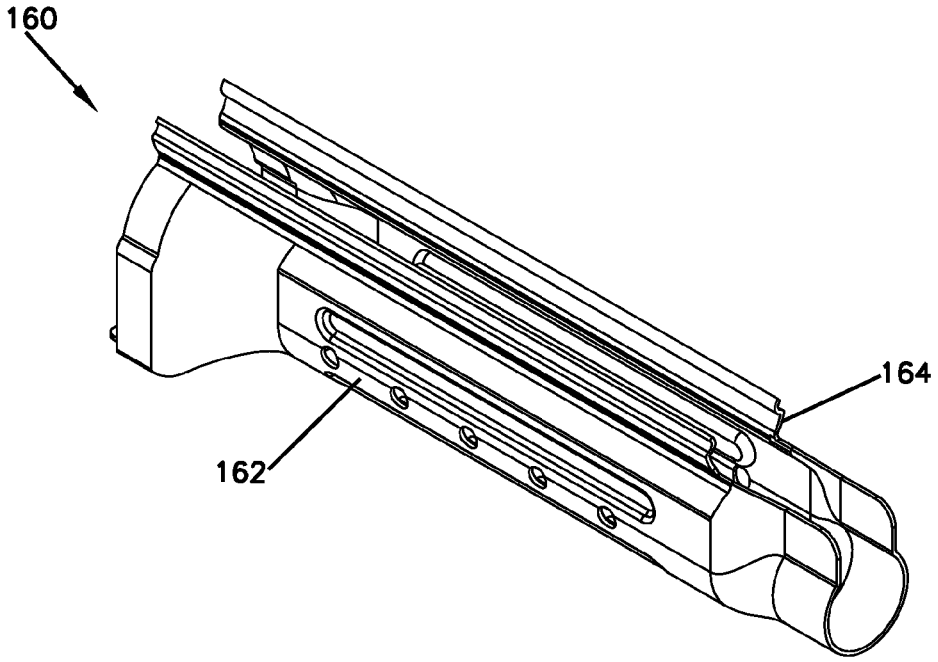
FIG. 5 is a perspective view of the firearm handgrip shown in FIG. 3.
Figure 6:
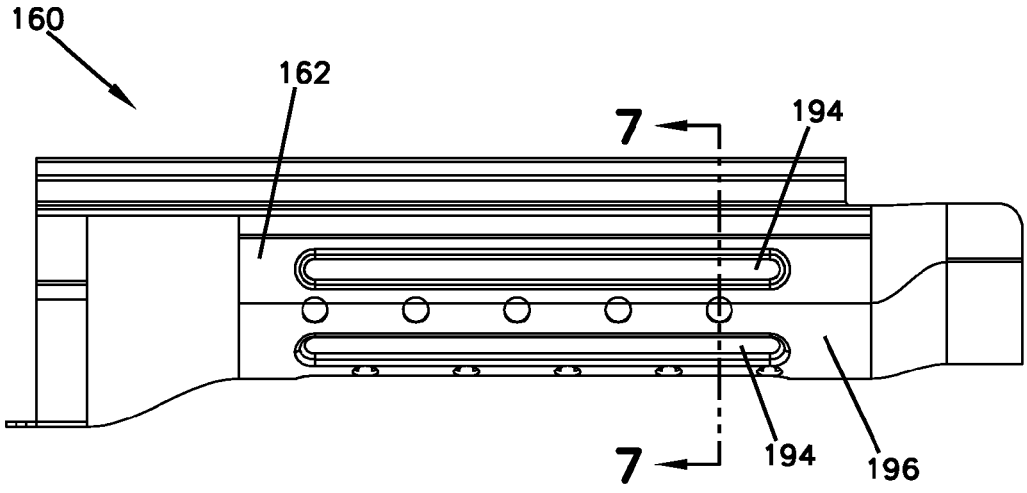
FIG. 6 is a right side view of the firearm handgrip shown in FIG. 3.
Figure 7:
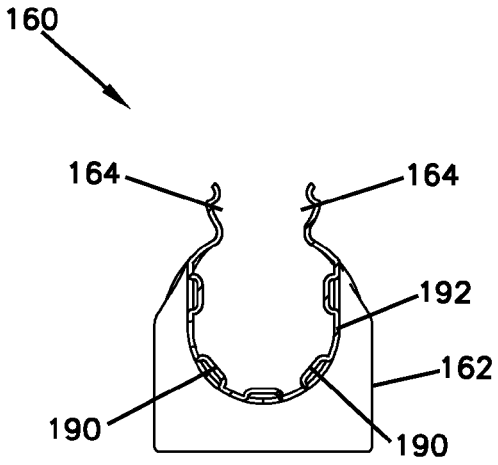
FIG. 7 is a cross-sectional view of the handgrip 160 of FIG. 3 along the line A-A in FIG. 6.

FIG. 5 is a perspective view of the example handgrip 160 of FIG. 3; FIG. 6 is a side view of the handgrip 160 of FIG. 3; FIG. 7 is a cross-sectional view of the handgrip 160 of FIG. 3 along the line A-A in FIG. 6. As shown in FIGS. 5-7, the handgrip 160 includes the gripping portion 162 and the grooves 164 as discussed above. In addition, with reference to FIGS. 6-7, the interior surface 192 of the handgrip 160 includes a plurality of ribs 190 corresponding to indentations 194 on the exterior surface 196 of the handgrip 160. In some examples, the grooves 164 are configured to mate with the ridges (e.g., the ridges 130 (FIG. 3)) of the gas tube 120 (FIG. 4) that is itself mounted to one of a variety of different barrel lengths and/or barrel calibers.

Figure 8:
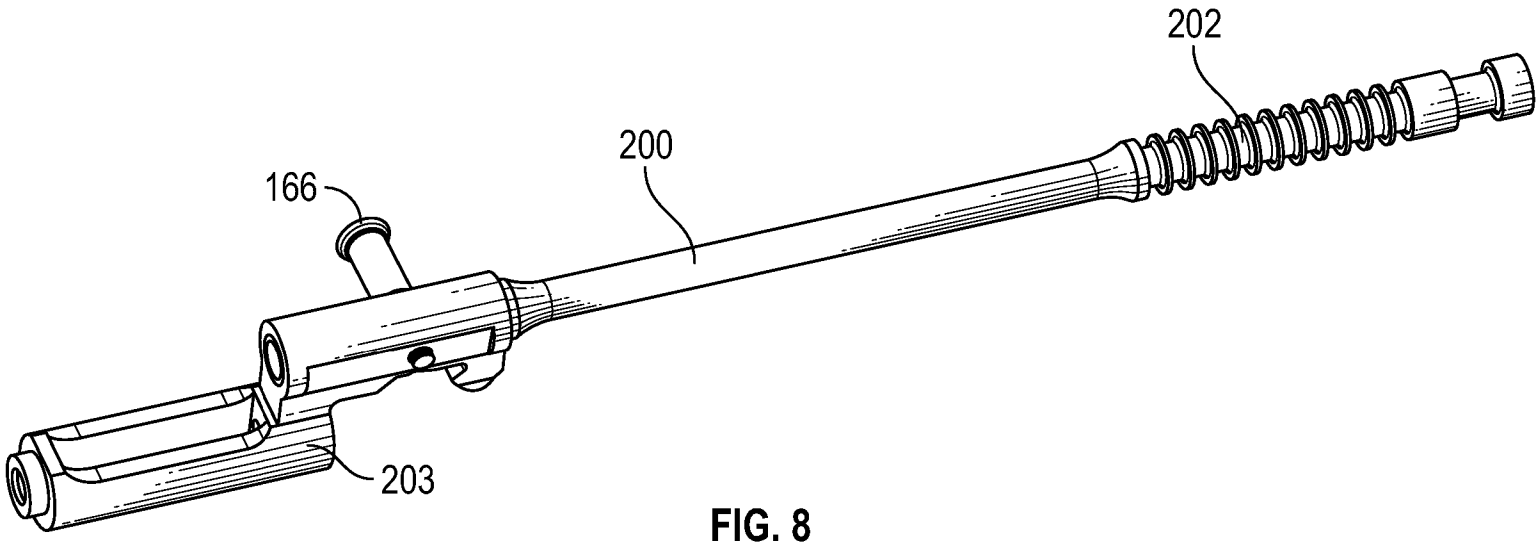
FIG. 8 is a perspective view of an example bolt carrier and gas piston in accordance with the present disclosure.

FIG. 8 is a perspective view of an example gas piston 200 and a bolt carrier 203 in accordance with the present disclosure. The gas piston 200 includes a spring 202. The gas piston 200 is partially housed by the gas tube 120 (FIG. 1) as discussed above, and its purpose and the purpose of the spring 202 are discussed above. In this embodiment the charging handle 166 is coupled to the bolt carrier 203. In some examples, the charging handle 166 is removably coupled to the bolt carrier 203. In other examples, the charging handle 166 is permanently coupled to the bolt carrier 203. In further embodiments the charging handle is coupled to the gas piston 200 directly, facilitating removal, replacement, and/or substitution of the gas piston 200 from the firearm 100 (FIG. 1).

Figure 9:
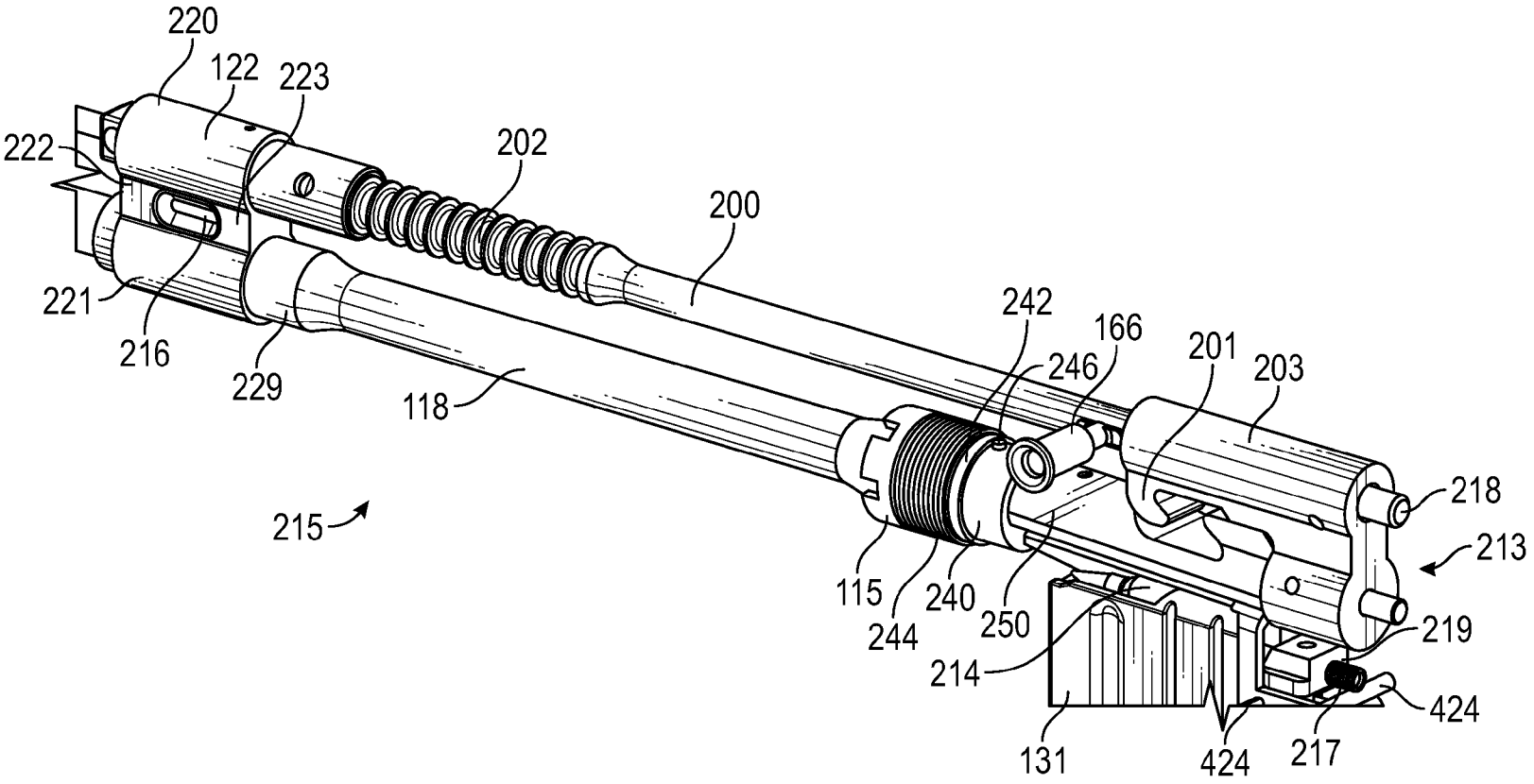
FIG. 9 is a perspective view of an embodiment of an example barrel assembly and bolt assembly in accordance with the present disclosure.

FIG. 9 is a perspective view of an embodiment of an example barrel assembly 215 and bolt assembly 213 in accordance with the present disclosure. In this example the barrel assembly 215 includes the barrel nut 115, the barrel 118 having the radially expanded section 229, the gas block 122, the charging handle 166, the gas piston 200, and the spring 202 as discussed above. In this example the barrel assembly 215 also includes a gas piston extension 218 and the gas block 122 includes a recess 216, which is a STG feature designed at least in part to reduce the overall weight of the firearm. As further shown in this example, the gas block 122 includes the upper portion 220, the lower portion 221, and the waist 222 disposed between the upper portion 220 and the lower portion 221 as discussed above. In addition, the gas block 122 includes a left side 223. The recess 216 is disposed in the left side 223 of the waist 222.

In other examples, the barrel assembly 215 optionally also includes one or more features that are mounted to or integral with one or more of the foregoing components of the barrel assembly (e.g., the front sight assembly 180 (FIG. 4), the stacking post 124 (FIG. 4), the sling loop 126 (FIG. 4), and/or the handgrip 160 (FIG. 3)). The barrel 118 includes a trunnion engaging portion 240 having an annular rib 242 and an index pin 246 extending from the top of the trunnion engaging portion 240 behind the annular rib 242. The barrel nut 115 includes a rear edge 244. When the barrel 118 is assembled together with the trunnion 114 (FIG. 1), the rear edge 244 of the barrel nut 115 contacts the front of the annular rib 242, preventing forward movement of the barrel 118. In addition, the rear of the annular rib 242 contacts a corresponding annular rib 248 (FIG. 20) protruding from the surface of the bore 314 (FIG. 20) of the trunnion 114 (FIG.

20), preventing rearward movement of the barrel 118 further into the trunnion 114 (FIG. 1). In addition, the index pin 246 mates with a corresponding cutout 249 (FIG. 20) in the top of the annular rib 248 (FIG. 20) of the trunnion 114 (FIG. 20) to properly align the barrel 118 and the rest of the barrel assembly with the other parts of the firearm 100 (FIG. 1).

In the example shown in FIG. 9, the bolt assembly 213 includes the bolt carrier 203 as discussed above having a bolt engagement portion 201, and also includes a set screw 217 and a bolt block 219. The bolt assembly 213 also includes a bolt 250 (see discussion below in connection with FIGS. 13-15). The bolt 250 is pulled rearwards by the bolt carrier 203, which engages or "carries" the bolt 250 by the bolt engagement portion 201 during a trigger reset. Also shown in FIG. 9 is a magazine 131 containing one or more rounds of ammunition 214.

In this example, the charging handle 166 is coupled directly (permanently or removably) to the gas piston 200 for ease of removal, replacement, and/or substitution of the gas piston 200, allowing the user to easily substitute a different barrel assembly (or one or more barrel assembly components) for the barrel assembly 215 or one or more of its components, respectively. This feature is distinguishable from the STG in which the charging handle is permanently affixed to the bolt carrier and the bolt carrier is permanently affixed to the gas piston, rendering the removal/replacement/substitution of these components virtually impossible.

Figure 15:
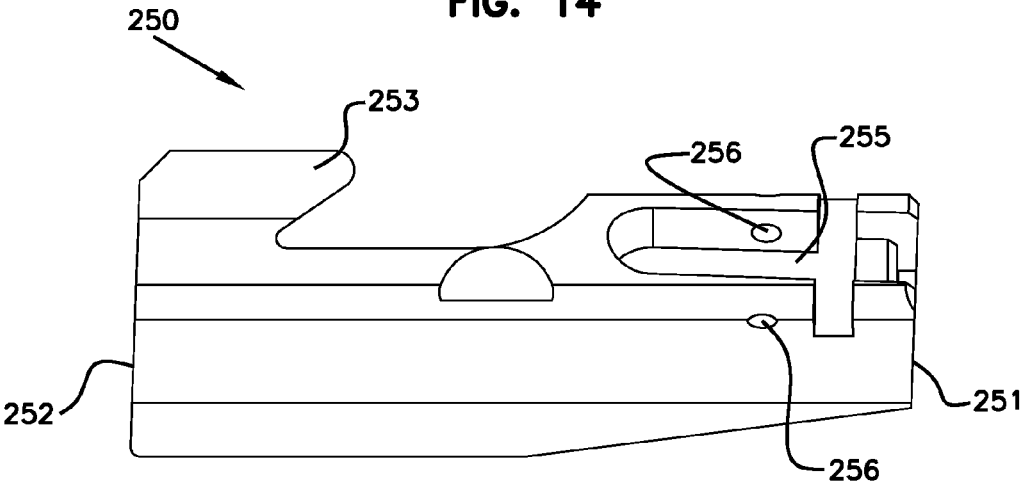
FIG. 15 is a side view of the bolt of FIG. 13.
Figure 16:
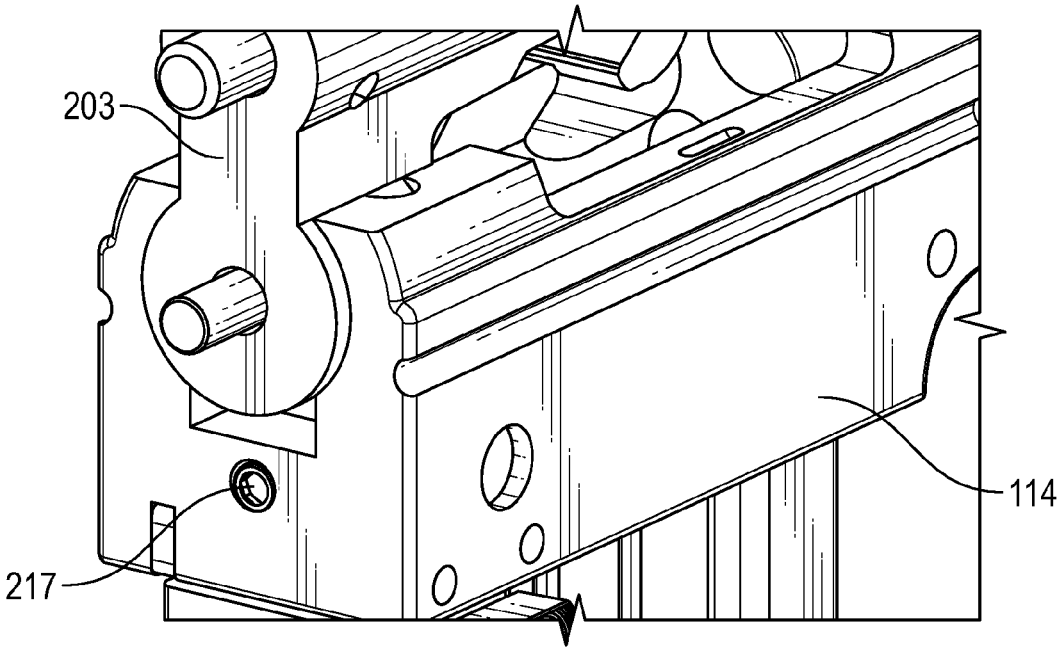
FIG. 16 is a partial rear perspective view of the example trunnion shown in the firearm in FIG. 1, as well as an example bolt carrier and set screw.

FIG. 9 also shows the gas piston extension 218 which removably couples to the bolt carrier 203. This coupling allows the gas piston 200 and the bolt carrier 203 to move forwards and rearwards in tandem during a firing cycle. When the bolt 250 (FIGS. 13-15) is thrust forward upon pulling of a trigger, a pin in the bolt contacts a round from the ammunition 214 that is loaded in a chamber, discharging the bullet forward through the barrel 118. The bolt block 219 and the set screw 217 are disposed at the rear of the trunnion 114 (FIG. 1) and allow the user to calibrate the firearm with the appropriate headspace between the bolt 210 and the bullet when the firearm is in a fire-ready position. Manual adjustment of the positioning of the bolt block 219 via the set screw 217 allows the user to calibrate the firearm (e.g., the firearm 100 of FIG. 1) for different caliber ammunition, an option not available on the STG. FIG. 16 is a partial rear perspective view of the trunnion 114 of FIG. 1 showing the bolt carrier 203 and the set screw 217. In some examples the magazine 131 holds STANAG (Standardization Agreement 4179) ammunition, though, as just described, the firearm 100 (FIG. 1) can be modified to support different types of ammunition as desired by the user.

Figure 10:
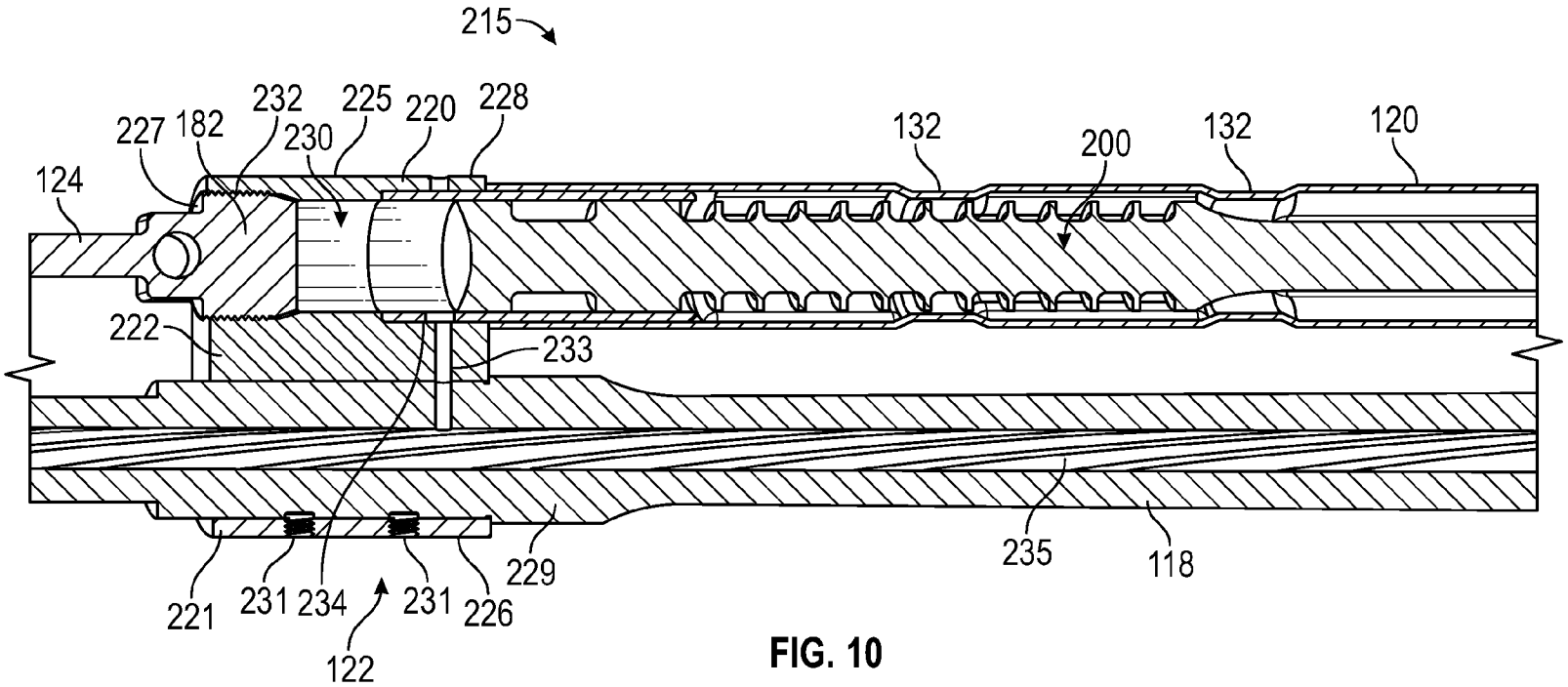
FIG. 10 is a side cross-sectional view of a portion of the barrel assembly shown in FIG. 9.

FIG. 10 is a side cross-sectional view a portion of the barrel assembly 215 of FIG. 9. The barrel assembly 215 includes the barrel 118 having the radially expanded section 229, the gas tube 120 having the waists 132, the gas piston 200, the stacking post 124 having the mounting portion 182, and the gas block 122 having the upper portion 220, the lower portion 221, the waist 222, the top 225, the bottom 226, the front side 227, and the rear side 228. In addition, in this example the gas block 122 also includes a gas redirecting element 230, set screws 231, screw threads 232, and a gas channel 233; the gas tube 120 includes a forward end 234; and the barrel 118 includes an internal bore 235.

The gas redirecting element 230 redirects gas (generated from firing a firearm) flowing upwards along the gas channel 233 from the internal bore 235 of the barrel 118 rearwards down the gas tube 120 such that it pushes the gas piston 200 rearwards as discussed above. The vertically oriented gas channel 233 is in gaseous communication with both the internal bore 235 of the barrel 118 and the interior of the gas tube 120. The set screws 231 secure the bottom 226 of the gas block 122 into corresponding screw holes in the bottom of the radially expanded section 229 of the barrel 118. The forward end 234 of the gas tube 120 connects towards the rear side 228 of the upper portion 220 of the gas block 122. The mounting portion 182 of the stacking post 124 removably mounts to the screw threads 232 disposed towards the front side 227 of the gas block 122.

Figure 11A:
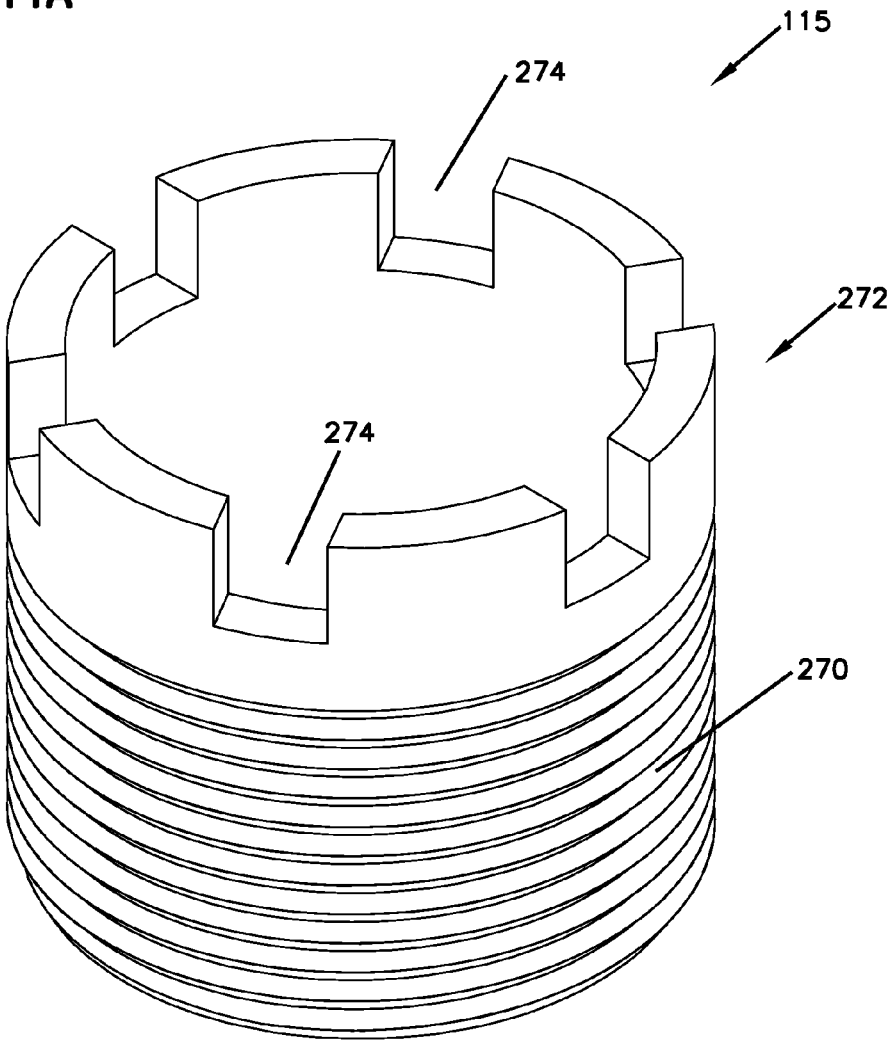
FIG. 11A is a perspective view of an example barrel nut used with the firearm of FIG. 1.
Figure 11B:
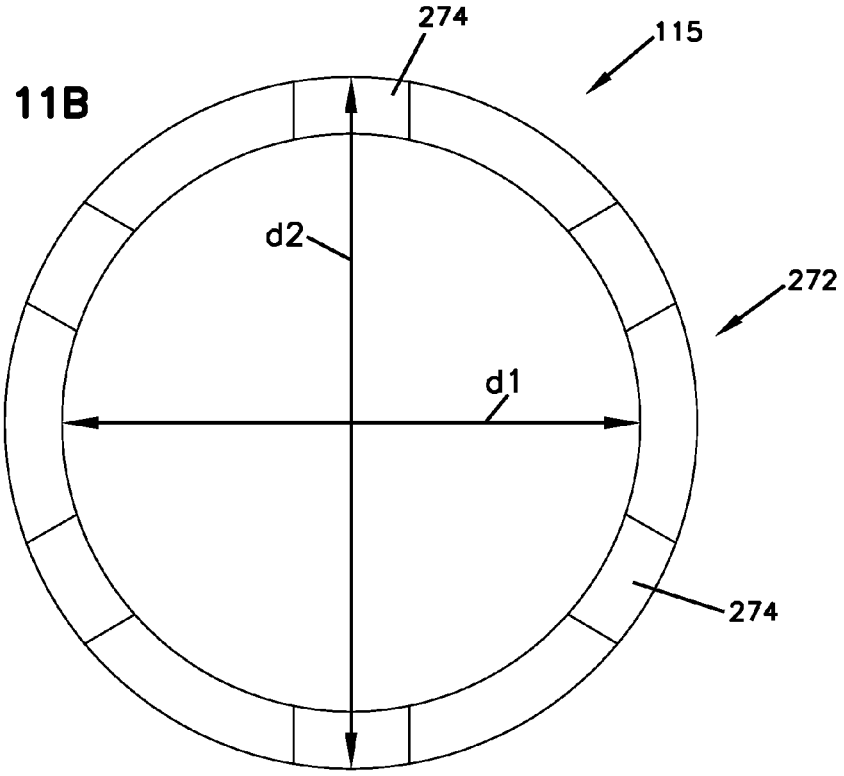
FIG. 11B is a front view of the barrel nut of FIG. 11A.
Figure 11C:
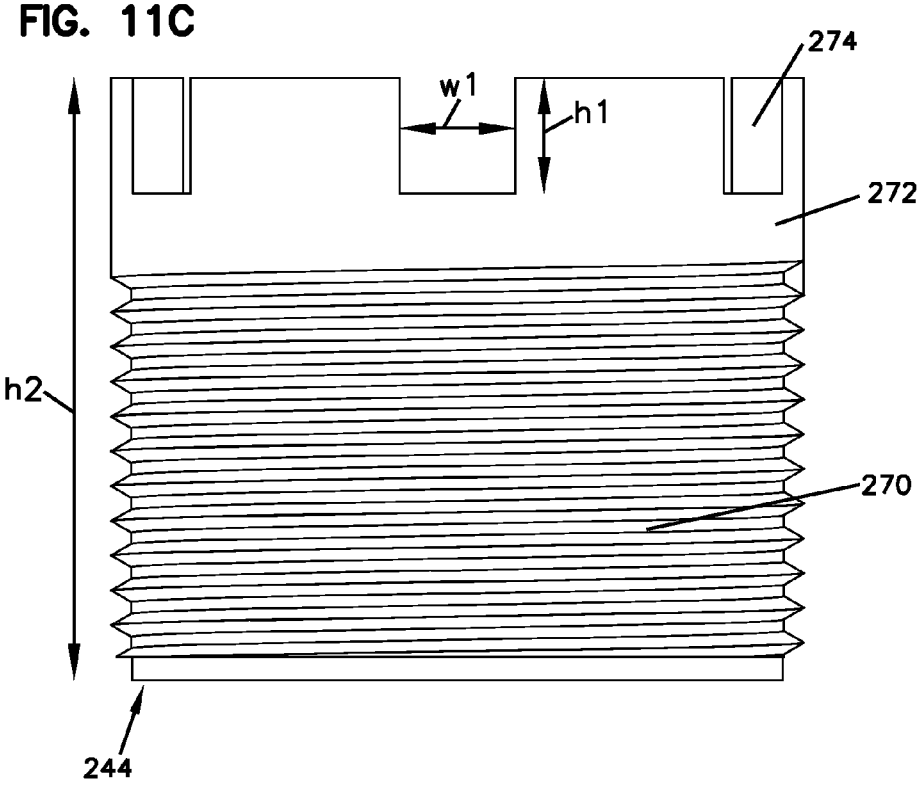
FIG. 11C is a side view of the barrel nut of FIG. 1.

FIG. 11A is a perspective view of an example barrel nut 115 used with the firearm 100 of FIG. 1. FIG. 11B is a front view of the barrel nut 115 of FIG. 11A. FIG. 11C is a side view of the barrel nut 115 of FIG. 11A. The barrel nut 115 includes the rear edge 244 described above, as well as a threaded portion 270 and a castellated portion 272, the castellated portion 272 having interspersed notches 274. The notches 274 are engageable by a barrel nut wrench and thereby facilitate sufficient torqueing of the barrel nut 115 to the trunnion 114 (FIG. 1) with a barrel nut wrench. The threaded portion 270 removably engages a corresponding threaded portion on an interior surface of the trunnion 114 (FIG. 1) to removably secure a barrel 118 (FIG. 1) to the trunnion 114. In this example, the barrel nut 115 has an inner diameter $d_1$, and an outer diameter $d_2$. Each of the notches 274 has a width $w_1$ and a height $h_1$. The barrel nut 115 has a height $h_2$. In some examples, the inner diameter $d_1$ is in a range from about 22 mm to about 28 mm. In a particular example, the inner diameter $d_1$ is about 25 mm. In some examples, the outer diameter $d_2$ is in a range from about 27 mm to about 33 mm. In a particular example, $d_2$ is about 30 mm. In some examples, each of $h_1$ and $w_1$ is in a range from about 3 mm to about 7 mm. In a particular example, each of $h_1$ and $w_1$ is about 5 mm. In some examples, $h_2$ is in a range from about 20 mm to about 30 mm. In a particular example, $h_2$ is about 26 mm. The values for $d_1$, $d_2$, $h_1$, $h_2$ and $w_1$ can also fall outside of these ranges.

In some examples, at least $d_2$ and $h_2$ are selected to ensure compatibility between the barrel nut 115 and the trunnion 114 (FIG. 1). In some examples, at least $d_1$ is selected to ensure compatibility between the barrel 118 (FIG. 1) and the barrel nut 115, and thereby compatibility between the barrel 118 (FIG. 1) and the trunnion 114 (FIG. 1). The STG did not include a barrel nut, and the barrel was permanently attached to the trunnion. As described below the trunnion 114 (FIG. 1) of the present disclosure allows the trunnion to be interchangeable with various barrels and barrel assemblies through the use of the barrel nut 115.

Figure 12:
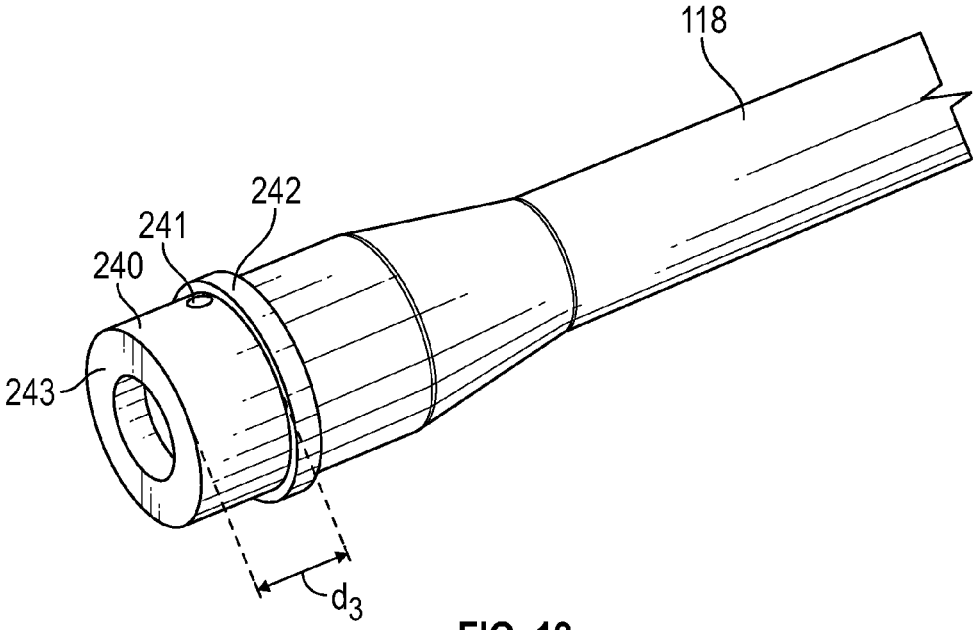
FIG. 12 is a perspective view of a rear portion of the barrel of the example firearm of FIG. 1.

FIG. 12 is an expanded view of the rear portion of the barrel 118 of FIG. 1, showing the trunnion engaging portion 240 of the barrel 118 and the annular rib 242. In addition, in this example the barrel 118 includes a recess 241 to house the index pin 246 (FIG. 9), and a rear end 243. The trunnion engaging portion 240 mates with the trunnion 114 (FIG. 1) and barrel nut 115 (FIG. 1) in the manner described above in connection with FIG. 9. In addition, the trunnion engaging portion 240 is configured to be removably mated with the barrel nut 115 (FIG. 1) and the trunnion 114 (FIG. 1), e.g., by unscrewing the barrel nut 115 from the trunnion 114, removing the barrel engaging portion 310 from the trunnion 114, and sliding the barrel nut 115 off the barrel 118. Removable coupling of the barrel 118 to the trunnion 114 (FIG. 1) in this manner allows for replacement and/or substitution of the barrel 118 and other components of the barrel assembly 215 (FIG. 9).

Figure 20:
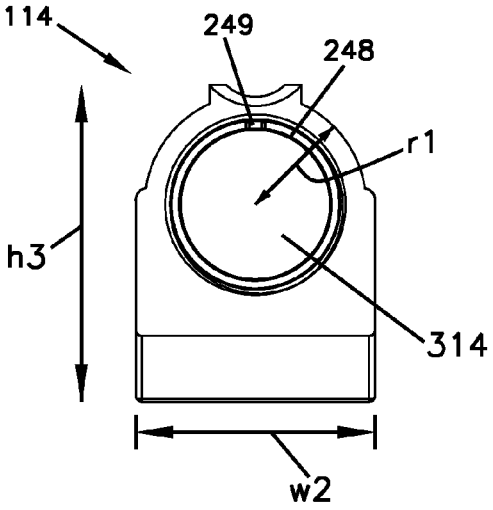
FIG. 20 is a front view of the trunnion shown in the example firearm in FIG. 1.

As shown in FIG. 12, there is a distance $d_3$ between the rear end 243 of the barrel 118 and the rear of the annular rib 242. The distance $d_3$ is selected to correspond to the distance between the front of the annular rib 248 (FIG. 20) in the trunnion 114 (FIG. 20) and the rear edge 244 of the barrel nut 115 (FIG. 9) when the barrel nut 115 (FIG. 9) is fully screwed into the trunnion 114 (FIG. 20). This effectively sandwiches the trunnion engaging portion 240 of the barrel 118 between the barrel nut 115 and the annular rib 248 of the trunnion 114, thereby preventing movement of the barrel 118 relative to the trunnion 114 (FIG. 1). Thus, by substituting differently dimensioned barrel nuts 115, the user of the firearm 100 can substitute barrels 118 having differently dimensioned trunnion engaging portions 240.

Figure 13:
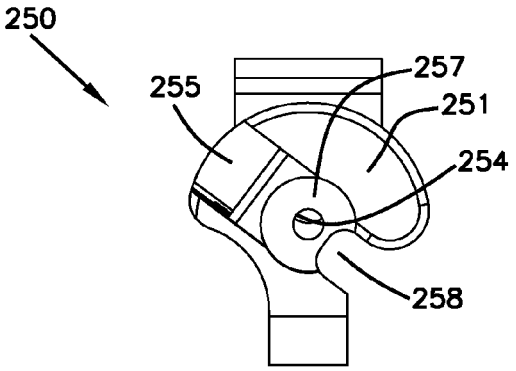
FIG. 13 is a front view of an example bolt that can be used with a firearm of the present disclosure.
Figure 14:
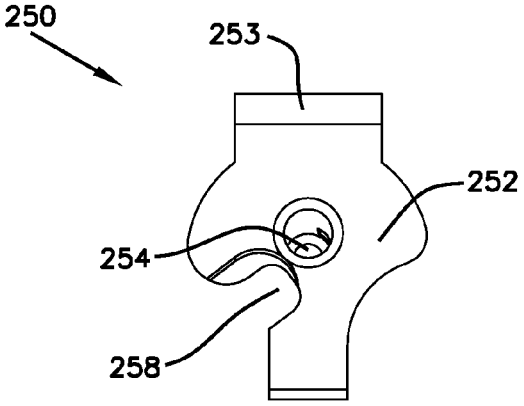
FIG. 14 is a rear view of the bolt of FIG. 13.

FIG. 13 is a front view of an example bolt 250 that can be used with a firearm of the present disclosure; FIG. 14 is a rear view of the bolt 250 of FIG. 13; and FIG. 15 is a side view of the bolt 250 of FIG. 13. The bolt 250 can be identical or similar in appearance and features to a bolt used in an STG. In this example, the bolt 250 is highly reminiscent of an STG bolt in appearance. Alternatively, a modern firearm bolt configuration may be used. As shown in FIGS. 13-15, the example bolt 250 includes a front face 251, a rear face 252, a bolt carrier engagement portion 253, a firing pin hole 254, an extractor recess 255 having an extractor engagement portion 256, and the front face 251 includes a cartridge interface 257. As in the STG, the example bolt 250 also includes a weight reducing groove 258, which desirably reduces the weight of the bolt 250 and thereby the overall firearm 100 (FIG. 1).

The front face 251 faces toward the front of the firearm (e.g., the firearm 100 as in FIG. 1) and engages the rear of the cartridge of a round of ammunition in the cartridge interface 257 when the trigger is cocked and ready to fire a round of ammunition 214 housed in the firearm chamber. The rear face 252 faces toward the rear of the firearm (e.g., the firearm 100 as in FIG. 1). The bolt carrier engagement portion 253 engages the bolt engagement portion 201 (FIG. 9), allowing the bolt 250 and the bolt carrier 203 (FIG. 9) to move forward and rearwards in tandem during each firing cycle. The firing pin hole 254 houses a firing pin during operation of a firearm 100 (FIG. 1), which, upon pulling of the trigger, strikes the rear of the ammunition round, causing an explosion that drives a projectile (e.g., a bullet) forwards from its cartridge and down the barrel 118 (FIG. 1). After the projectile has been released the spent cartridge remains briefly engaged by the cartridge interface 257. As the bolt reciprocates rearwards from the force applied by the gas piston 200 (FIG. 9) on the bolt carrier 203 (FIG. 9) as discussed above, the bolt 250 rotates, forcing the spent cartridge into the extractor recess 255. In some examples, a spring loaded extractor platform is pivotally secured to the extractor engagement portion 256 within the extractor recess 255. The bias of the spring ejects the spent cartridge through the ejector port 116 (FIG. 7) as another round of ammunition 214 (FIG. 9) is loaded from the magazine 131 (FIG. 9) into the chamber.

Figure 17:
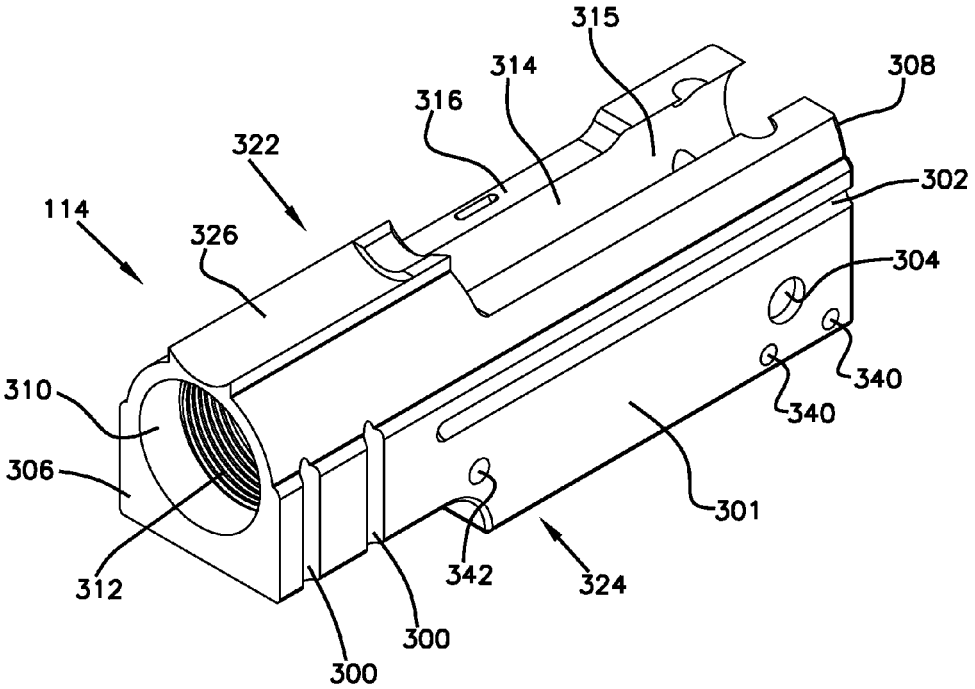
FIG. 17 is a front perspective view of the trunnion shown in the example firearm in FIG.
Figure 18:
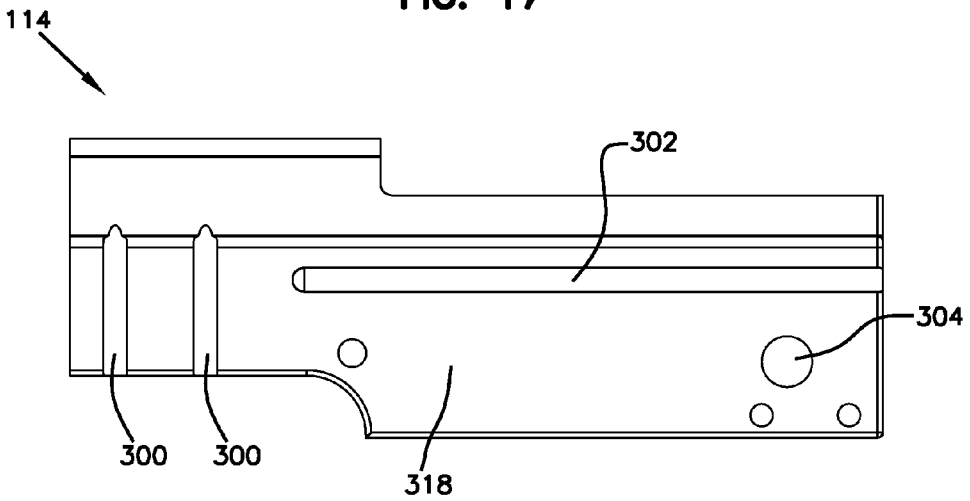
FIG. 18 is a left side view of the trunnion shown in the example firearm in FIG. 1.
Figure 19:
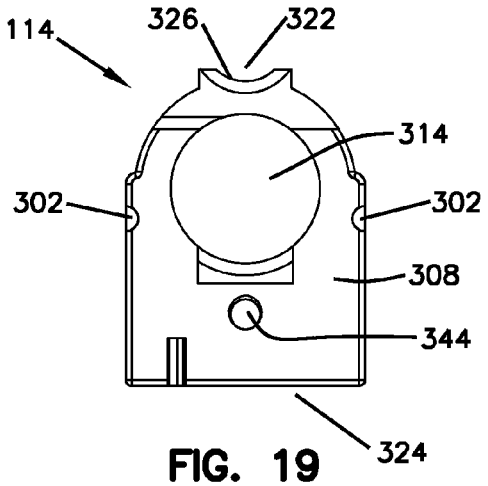
FIG. 19 is a rear view of the trunnion shown in the example firearm in FIG. 1.
Figure 21:
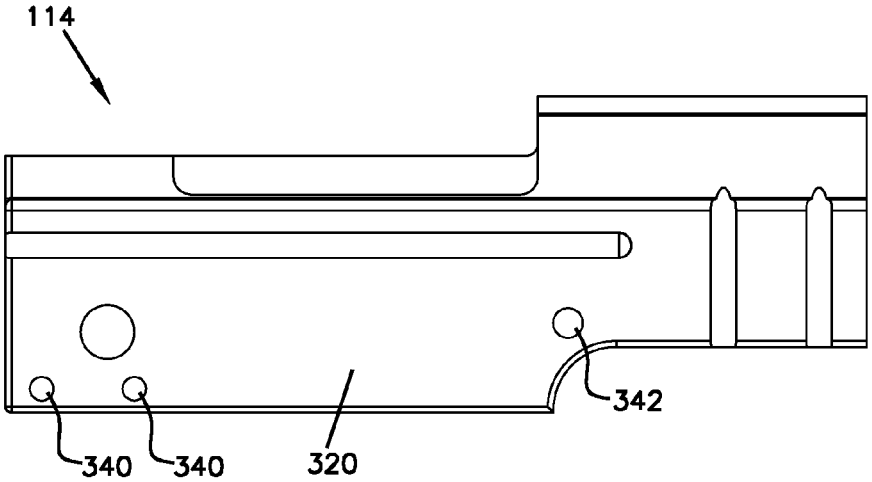
FIG. 21 is a right side view of the trunnion shown in the example firearm in FIG. 1.
Figure 22:
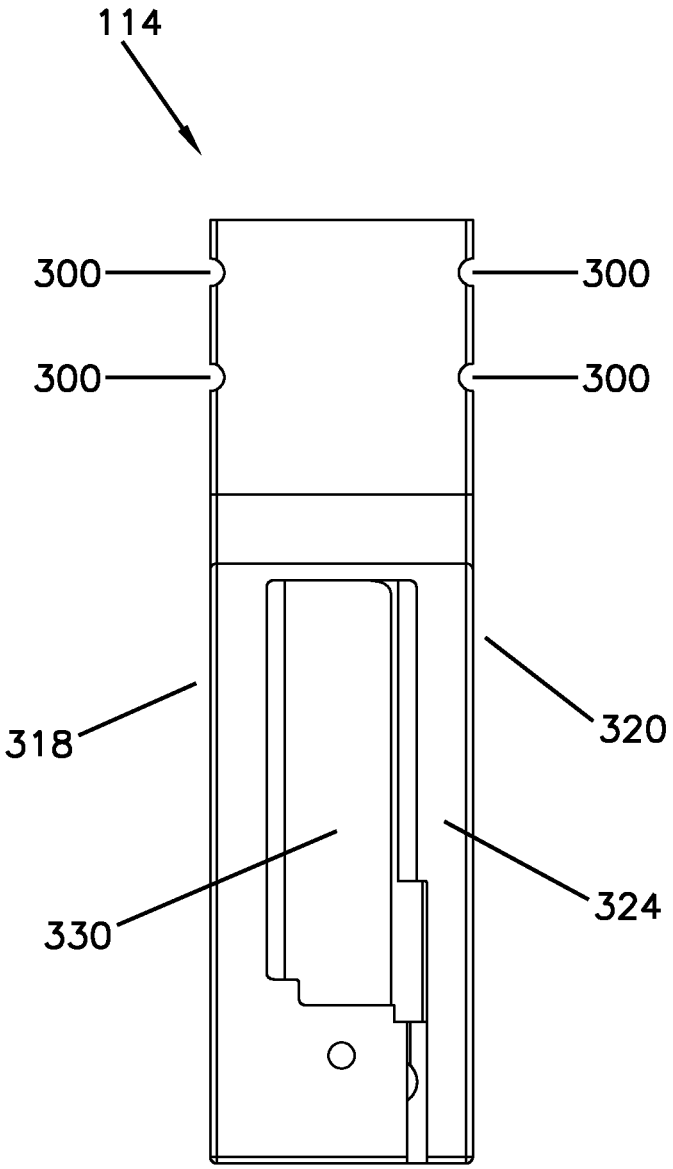
FIG. 22 is a bottom view of the trunnion shown in the example firearm in FIG. 1.

FIG. 17 is a top front perspective view of an example trunnion 114 in accordance with the present disclosure; FIG. 18 is a left side view of the trunnion 114 of FIG. 17; FIG. 19 is a rear view of the trunnion 114 of FIG. 17; FIG. 20 is a front view of the trunnion 114 of FIG. 17; FIG. 21 is a right side view of the trunnion 114 of FIG. 17; and FIG. 22 is a bottom view of the trunnion 114. As shown in FIGS. 17-19 and 22, the example trunnion 114, as in an STG trunnion includes two vertically oriented elongated recesses 300 on the left side and the right side toward the front, and a horizontally oriented elongate recess 302 near the top of the trunnion 114 on the left side and right side disposed behind the vertically oriented elongated recesses 300, and a conical depression 304 towards the rear of the trunnion 114 and below the horizontally oriented elongated recess 302. The trunnion 114 coordinates a barrel assembly and bolt assembly for repeat firing of a firearm. The example trunnion 114 also includes an outer surface 301, a front face 306, a rear face 308, a barrel engaging portion 310, screw threads 312, a bore 314, a slot 315, an ejector cutout 316, a left side 318, a right side 320, a top 322, and a bottom 324. The trunnion 114 also includes a curved platform 326. With reference to FIG. 22, the bottom 324 of the trunnion 114 includes an opening 330. With reference to FIG. 20, the trunnion 114 also includes the annular rib 248 extending from the surface of the bore 314, and the cutout 249 corresponding to the index pin 246 (FIG. 9) on the trunnion engaging portion 240 (FIG. 9) of the barrel 118 (FIG. 9), as discussed above in connection with FIGS. 9 and 12.

In some examples, to maintain an outward appearance of the STG a rivet is used to attach the receiver (e.g., the receiver 112 in FIG. 1) and the trunnion together. In some examples the trunnion 114 and the receiver 112 (FIG. 1) are attached to each other by bending the upper receiver on a metal stamping press, inserting the trunnion 114 and through a series of resistance welds or pins permanently attaching the trunnion 114 to the receiver 112 (FIG. 2). In some examples, the trunnion 114 is only removable from the receiver 112 (FIG. 2) by irrevocably destroying the receiver 112 (FIG. 2). In some examples, once the trunnion 114 is inserted into the receiver 112 (FIG. 2) and a series of welds are performed, the upper portion of the receiver 112 (FIG. 2) is pressed strongly into the trunnion 114 and is bent in such a way to correspond to at least: the vertically oriented elongated recesses 300 (corresponding to the vertically oriented elongated recesses 142 of FIG. 2); the horizontally oriented elongated recess 302 (corresponding to the horizontally oriented elongated recess 144 of FIG. 2); and the conical depression 304 (corresponding to the conical depression 146 of FIG. 2) on both the left side 318 and the right side 320 of the trunnion 114, in order to thereby immobilize the trunnion 114 and the receiver 112 (FIG. 2) together.

The front face 306 faces frontwards when the trunnion 114 is installed in a firearm 100 (FIG. 1); and the rear face 308 faces rearwards. The barrel engaging portion 310 receives the trunnion engaging portion 240 (FIG. 12) of the barrel 118, typically within a barrel nut 115 (FIG. 1) that has been secured (e.g., via screw action) to the screw threads 312 disposed within the barrel engaging portion 310. The bore 314 houses the bolt assembly 213 (FIG. 9) and allows for forward and rearward movement of the bolt assembly 213 (FIG. 9) therein during each firing cycle. The slot 315 is a longitudinal (from the rear face 308 towards the front face 306) opening in the top of the bore 314. The slot 315 allows the bolt assembly 213 (FIG. 9) to cooperate with the gas piston 200 (FIG. 9), which is disposed above the trunnion 114 and rests partially in the curved platform 326 on the top 322 of the trunnion 114. The ejector cutout 316 is in open communication with the ejector port 116 (FIG. 1) of the receiver 112 (FIG. 1) and permits sufficient space for spent cartridges to be ejected through the ejector port 116 (FIG. 1).

The opening 330 in the bottom 324 of the trunnion 114 allows for cooperation between the bolt assembly 213 (FIG. 9) housed within the trunnion 114 on the one hand, and the magazine 131 (FIG. 9) containing one or more rounds of ammunition 214 (FIG. 9) on the other hand, the ammunition 214 (FIG. 9) being loaded upwards into the trunnion 114 from the magazine 131 (FIG. 9) via spring action during each firing cycle. In one example, in contrast to the corresponding aspect of a STG, the opening 330 is sized and shaped to accommodate the feeding of ammunition from a STANAG pattern magazine.

With reference to FIGS. 17 and 21, ejector pinholes 340 on either side of the trunnion 114 are configured to receive pins for mounting an ejector inside the trunnion 114, the ejector being configured to catch spent ammunition cartridges from the bolt and discharge the spent cartridges through the ejector port 116 (FIG. 1). In some examples, relative to ejector pinholes on the STG, the ejector pinholes 340 (and, correspondingly, the pins they receive) are closer to each other and offset rearwards, i.e. closer to the rear face 308 of the trunnion 114, than in a STG. In some examples, the pinholes 340 are in a range from about 0.1 mm to about 2.0 mm closer to each other and the rearmost pinhole 340 on either side of the trunnion 114 is in a range from about 3 mm to about 7 mm closer to the rear face 308 of the trunnion 114, as compared with a STG. In a particular example, the pinholes 340 are about 0.5 mm closer to each other, and the rearmost pinhole 340 on either side of the trunnion 114 is about 5.5 mm closer to the rear face 308 of the trunnion 114, as compared with a STG. The offset of the ejector pinholes 340 as compared with the ejector pinholes on the STG can help to accommodate the other modifications to the trunnion 114 (e.g., its configuration to removably couple to a barrel, the presence of the bolt block 219 (FIG. 9), the caliber of ammunition received in the trunnion 114, and so forth) that enable the trunnion 114 to accommodate interchanging firearm components.

With further reference to FIGS. 17 and 21, a forward pinhole 342 on either side of the trunnion 114 is configured to receive a pin that passes through corresponding pinholes in either side of the receiver 112 (FIG. 1). In some examples, a bolt is passed through the receiver 112 and the forward pinhole 342 on both sides of the receiver 112 and the trunnion 114, and the pin is then riveted to the outer surface of the receiver 112, which can help permanently secure the receiver 112 and the trunnion 114. In some examples, the forward pinhole 342 has a smaller diameter than a corresponding forward pinhole on the trunnion of a STG. In some examples, the forward pinhole 342 has a diameter that is smaller than the corresponding pinhole on a STG by an amount in a range from about 1 mm to about 6 mm. In a particular example, the forward pinhole 342 has a diameter that is approximately 3 mm smaller than the corresponding pinhole on a STG.

In some examples, relative to the forward pinhole on a STG, the forward pinhole 342 on either side of the trunnion 114 (and, correspondingly, the pin it receives) is offset rearwards, i.e. closer to the rear face 308 of the trunnion 114, than in a STG. In some examples, the forward pinhole 342 is in a range from about 10 mm to about 30 mm closer to the rear face 308 of the trunnion 114, as compared with a STG. In a particular example, the forward pinhole 342 is about 18 mm closer to the rear face 308 of the trunnion 114, as compared with a STG. The offset of the forward pinhole 342 as compared with the forward pinhole on a STG, as well as the smaller diameter, can help to accommodate the other modifications to the trunnion 114 that enable the trunnion 114 to accommodate interchanging firearm components (e.g., an interchangeable barrel, the inclusion of screw threads on an inner surface of the trunnion 114 and forward of the forward pinhole 342, the screw threads removably receiving a barrel nut for removably coupling a barrel to the trunnion 114).

With reference to FIG. 19, disposed below the bore on the rear face 308 of the trunnion 114 is a threaded hole 344 configured to receive the set screw 217 (FIG. 9) for adjusting the bolt block 219 (FIG. 9), as discussed above. STG trunnions do not include a bolt block; nor do STG trunnions provide the capability to calibrate the firearm for different caliber ammunition through use of a bolt block. As such, STG trunnions do not include the threaded hole 344.

With further reference to FIG. 19, the trunnion 114 has an overall width $w_2$, an overall height $h_3$, and the upper curved portion has an outer radius $r_1$. In some examples, each of $w_2$, $h_3$ and $r_1$ is larger than the corresponding dimension in a STG in order to accommodate interchanging of firearm components in the firearm 100 (FIG. 1), e.g., through the use of a barrel nut 115 (FIG. 1) removably disposed in the bore 314 of the trunnion 114. In some examples, $w_2$ is larger than the corresponding dimension in a STG by an amount in a range from about 1 mm to about 10 mm; $h_3$ is larger than the corresponding dimension in a STG by an amount in a range from about 0.5 mm to about 5 mm; and $r_1$ is larger than the corresponding dimension in a STG by an amount in a range from about 1 mm to about 8 mm. In a particular example, $w_2$ is about 40 mm, and about 5 mm wider than the corresponding STG dimension; $h_2$ is about 53 mm, and about 1.5 mm higher than the corresponding STG dimension; and $r_1$ is about 18.5 mm, and about 3 mm greater than the corresponding STG dimension.

Figure 23:
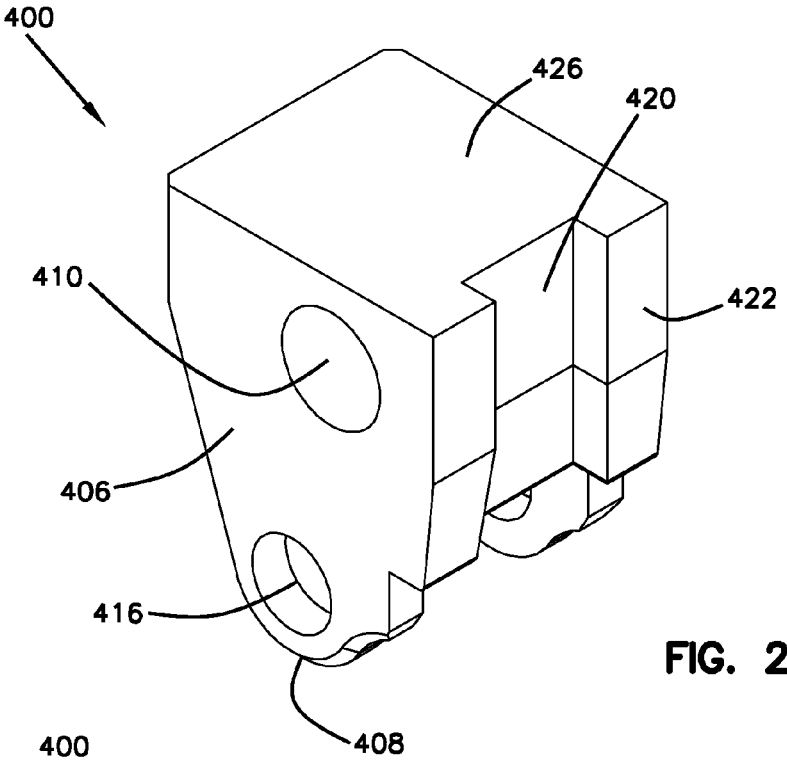
FIG. 23 is a perspective view of a magazine retention block that can be used in a firearm in accordance with the present disclosure.
Figure 24:
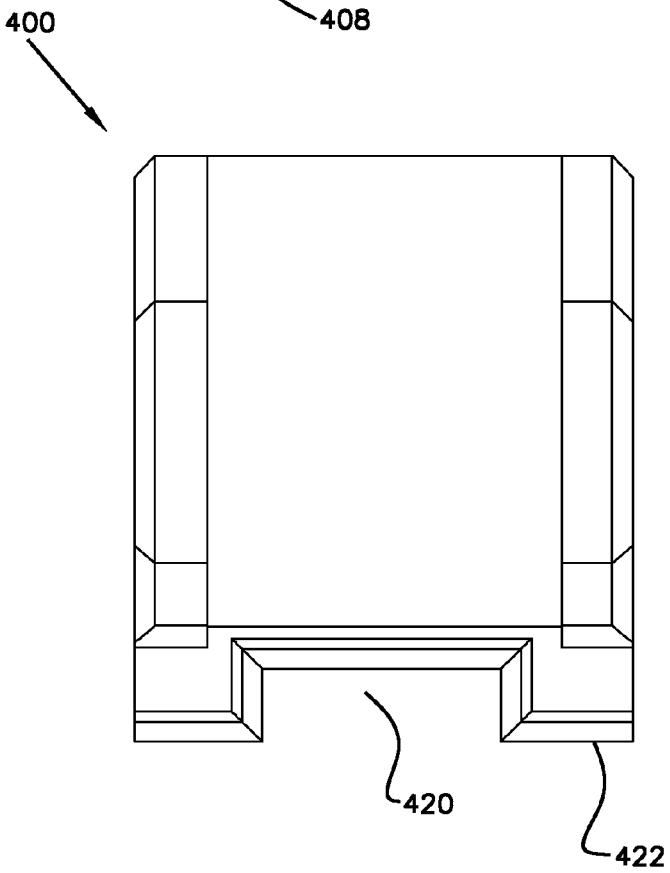
FIG. 24 is a bottom view of the magazine retention block of FIG. 23.

FIG. 23 is a perspective view of a magazine retention block 400 that can be used in a firearm (e.g., the firearm 100 of FIG. 1) in accordance with the present disclosure; FIG. 24 is a bottom view of the magazine retention block 400 of FIG. 23. The magazine retention block 400 assists in coupling a magazine 131 (FIG. 9) to the trunnion 114 (FIG. 1) and smoothly and repeatedly feeding rounds of ammunition (e.g., ammunition 214 in FIG. 9) from the magazine 131 (FIG. 9) into a chamber for firing from the firearm. In the addition, the structure of the magazine retention block 400, and its placement within the receiver of the firearm reinforces the strength of the receiver. The magazine retention block 400 is not a feature of the STG.

Figure 25:
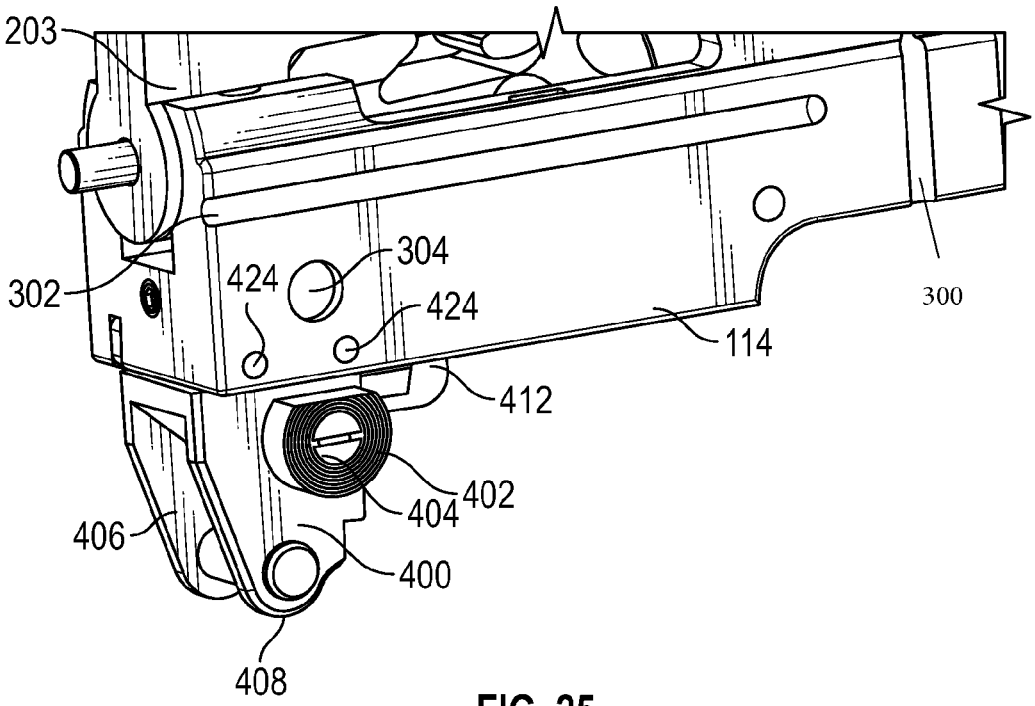
FIG. 25 is a perspective view of a partial firearm assembly including the trunnion shown in the example firearm in FIG. 1 and the magazine retention block shown in FIG. 23.

FIG. 25 is a perspective view of a portion of the trunnion 114 and the magazine retention block 400, showing the bolt carrier 203, the vertically oriented elongated recess 300, the horizontally oriented elongated recess 302, and the conical depression 304 discussed above. In addition, in this example a magazine release mechanism 402 including a button 404 is coupled to the magazine retention block 400.

Figure 26:
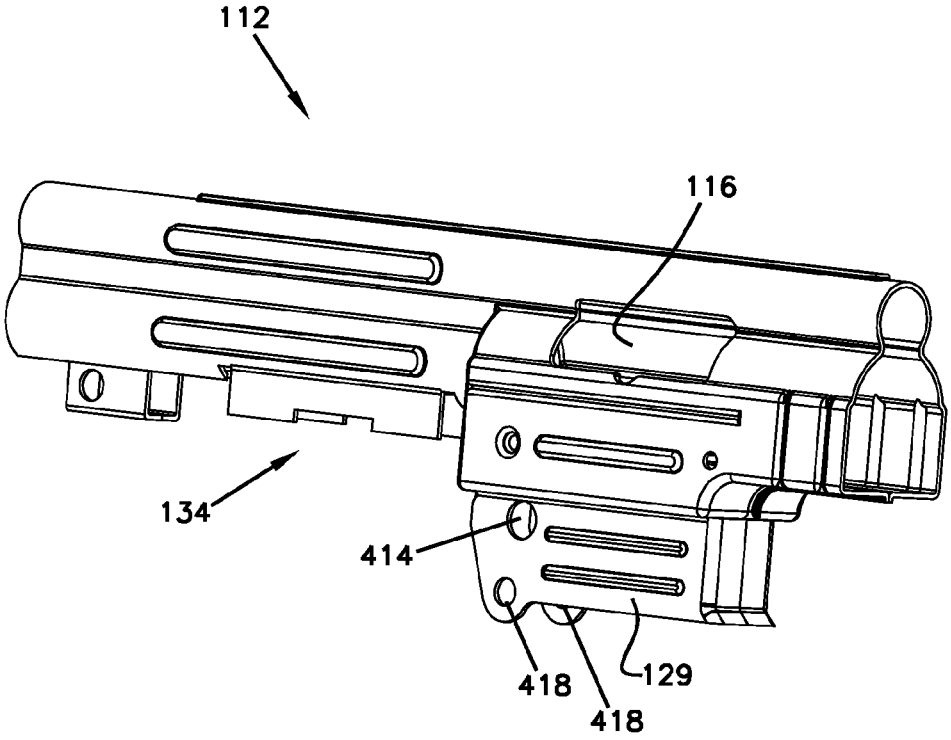
FIG. 26 is a perspective view of a portion of firearm receiver in accordance with the present disclosure.
Figure 27:
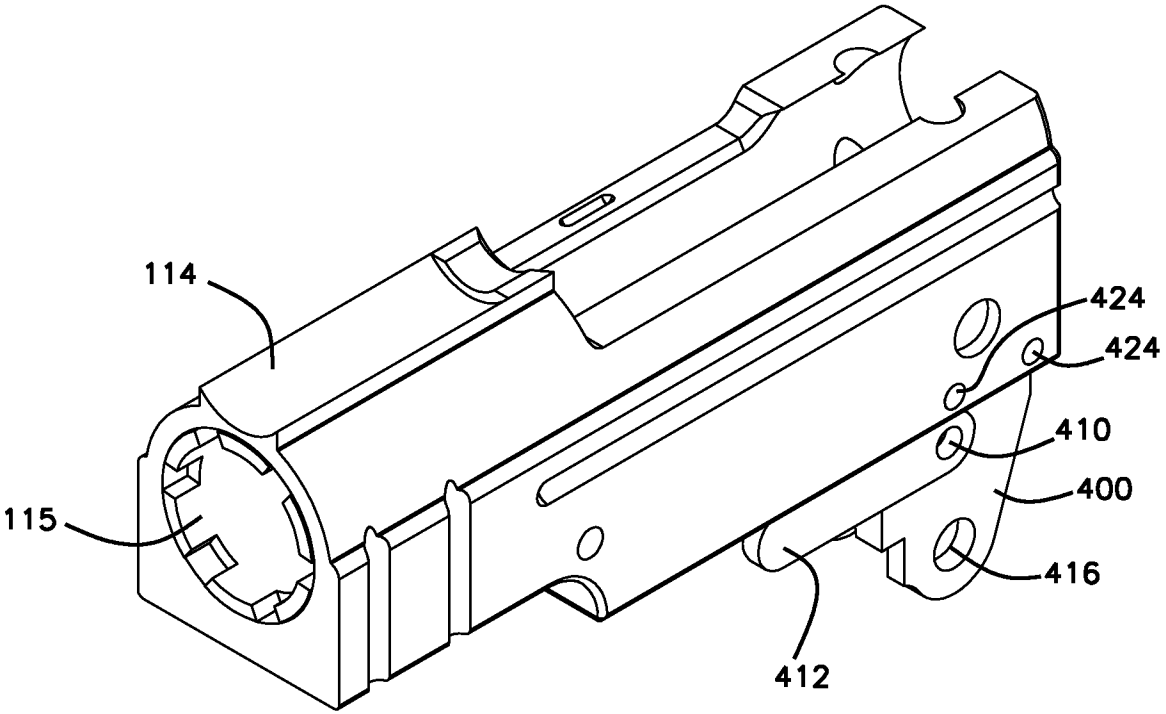
FIG. 27 is a left side perspective view of a trunnion 114, a barrel nut 115, and a magazine retention block 400 in accordance with a firearm of the present disclosure.

FIG. 26 is a perspective view of a portion of the receiver 112 of FIG. 1B, including the trigger coupling area 134, the magazine holder 129, and the ejector port 116 as described above. FIG. 27 is a left side perspective view of the trunnion 114, the barrel nut 115, and the magazine retention block 400 as described above.

With reference to FIGS. 23-27, the magazine retention block 400 includes a tapered portion 406 that tapers downward toward the bottom 408 of the magazine retention block 400. The tapered portion 406 acts as a guide that facilitates sliding and coupling of a magazine (e.g, the magazine 131 (FIG. 1B)) to the receiver 112 (FIG. 1B), e.g., by coupling the magazine 131 to the magazine holder 129 (FIG. 26). An upper pin hole 410 enables, via a pin, the coupling of the magazine catch 412 to the button 404 of the magazine release mechanism 402 via a spring, the button being accessible to the user on the outside of the receiver 112 through an opening 414 in the magazine holder 129. Pressing the button 404 compresses the spring which pivots the magazine catch 412, thereby releasing the magazine (e.g., the magazine 131 (FIG. 1B)) from the magazine holder 129. A lower pin hole 416 enables, via a pin, forward pivotal coupling of a trigger assembly 136 (FIG. 1B) to the firearm 100 (FIG. 1B), the pin extending through a portion of the trigger assembly 136 and through the corresponding openings 418 in the magazine holder 129.

With reference to FIGS. 23 and 24, a groove 420 disposed in the front face 422 of the magazine retention block 400 helps to guide rounds of ammunition upward into the chamber of the firearm 100 (FIG. 1B) for shooting. In some examples, the width of the groove 420 tapers toward the upper surface 426 of the magazine retention block 400 to help guide ammunition rounds.

With reference to FIGS. 23, 25, 27 and 9, the magazine retention block 400 is disposed beneath and abuts a pair of pins 424 that support the bolt block 219 (FIG. 9). In some examples the upper surface 426 of the magazine retention block 400 rests up against the pair of pins 424, which can help prevent loosening or dislodgment of the pair of pins 424 as well as the bolt block 219.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A firearm, comprising:

a barrel associated with a first firearm model and having a front end and a first barrel nut engaging portion at a rear end;

a gas block;

a gas tube;

a gas piston;

a barrel nut having a threaded portion;

a charging handle;

a receiver associated with the first firearm model; and a trunnion comprising:

an outer surface defined by a front face, a rear face, a top, a bottom, a right side, and a left side;

a bore extending longitudinally from the front face to the rear face and configured to hold a bolt and a portion of a bolt carrier;

a second barrel nut engaging portion disposed at a front end of the bore and comprising screw threads for receiving the threaded portion of the barrel nut;

a curved platform disposed on the top of the trunnion and configured to receive the gas piston;

a slot disposed on the top of the trunnion behind the curved platform, the bolt carrier extending above the slot and coupling to the gas piston above the trunnion;

an ejector cutout for ejecting spent ammunition cartridges, the ejector cutout disposed on one of the left side or right side of the trunnion;

an opening in the bottom of the trunnion for receiving ammunition from a magazine into the trunnion; and a bolt block comprising a set screw for adjusting a position of the bolt block;

wherein the outer surface of the trunnion on each of the left side and the right side comprises a conical depression, two parallel vertically oriented elongated recesses disposed towards the front face of the trunnion and extending upwardly from the bottom of the trunnion, and a horizontally oriented elongated recess disposed behind the two vertically oriented elongated recesses and above the conical depression, the horizontally oriented elongated recess extending forwardly from the rear face of the trunnion;

wherein the second barrel nut engaging portion removably mates with the barrel nut;

wherein the barrel nut removably mates with the barrel; and wherein the firearm is configured to substitute at least one of the barrel, the barrel nut, the gas block, and the gas tube with a component from a second firearm model; and wherein adjustment of the set screw configures the firearm for use with a plurality of types of ammunition.

2. The firearm as in claim 1, wherein the firearm is configured to substitute at least one of the barrel, the barrel nut, the gas block, and the gas tube with a component from a second firearm model and a component from a third firearm model.

3. The firearm as in claim 1, further comprising a removable stacking post having a front end and a rear end, the stacking post including a mounting portion at the rear end of the stacking post, the mounting portion of the stacking post configured for removably mounting the stacking post to a front end of the gas block.

4. The firearm as in claim 1, further comprising a handguard having an outer surface and a plurality of grooves on an inner surface, wherein the gas tube comprises an inner surface and a plurality of longitudinally extending ridges on an outer surface, and wherein each of the plurality of grooves removably mates with one of the plurality of longitudinally extending ridges to removably couple the handguard to the gas tube.

5. The firearm as in claim 1, wherein the gas block comprises a waist, and wherein a sling loop extends from a first side of the waist of the gas block.

6. The firearm as in claim 5, wherein a second side of the waist comprises a recess, the second side being opposite the first side.

7. The firearm as in claim 1, wherein the firearm is a semi-automatic tilting-bolt rifle.

8. The firearm as in claim 1, wherein the charging handle is fixedly coupled to the gas piston.

9. The firearm as in claim 1, wherein the charging handle is removably coupled to the bolt carrier.

10. The firearm as in claim 1, wherein the bolt block is disposed behind the bolt, and wherein the set screw is configured for adjusting a head space between the bolt and a round of ammunition in the firearm.

11. The firearm as in claim 1, further comprising a forward sight, wherein the forward sight is removably coupled to the barrel, and wherein the forward sight comprises two forward sight set screws that couple to the barrel, the forward sight set screws being configured to adjust a position of the forward sight to account for windage.

12. The firearm of claim 1, wherein the receiver comprises a magazine holder, and wherein the firearm further comprises a magazine retention block, the magazine retention block configured to couple the magazine to the magazine holder.

13. A firearm, comprising:

a barrel associated with a first firearm model and having a front end and a first barrel nut engaging portion at a rear end;

a magazine;

a magazine retention block comprising a top surface, a tapered portion that tapers towards a bottom of the magazine retention block, a front surface having a groove, a magazine catch, and a magazine catch release;

a barrel nut having a threaded portion;

a receiver associated with the first firearm model and comprising a magazine holder for engaging the magazine; and a trunnion comprising:

an outer surface defined by a front face, a rear face, a top, a bottom, a right side, and a left side;

a bore extending longitudinally from the front face to the rear face and configured to hold a bolt and a portion of a bolt carrier;

a second barrel nut engaging portion disposed at a front end of the bore and comprising screw threads for receiving the threaded portion of the barrel nut;

wherein the outer surface of the trunnion on each of the left side and the right side comprises a conical depression, two parallel vertically oriented elongated recesses disposed towards the front face of the trunnion and extending upwardly from the bottom of the trunnion, and a horizontally oriented elongated recess disposed behind the two vertically oriented elongated recesses and above the conical depression, the horizontally oriented elongated recess extending forwardly from the rear face of the trunnion;

wherein the second barrel nut engaging portion removably mates with the barrel nut;

wherein the barrel nut removably mates with the barrel; and wherein the firearm is configured to substitute at least one of the barrel, the barrel nut, and the magazine with a component from a second firearm model.

14. The firearm as in claim 13, further comprising a bolt block supported by a pin, and wherein the top surface of the magazine retention block abuts the pin.

15. The firearm as in claim 14, wherein the bolt block comprises a set screw for adjusting a position of the bolt block, and wherein adjustment of the set screw configures the firearm for use with a plurality of types of ammunition.

16. The firearm as in claim 15, wherein the bolt block is disposed behind the bolt, and wherein the set screw is configured for adjusting a head space between the bolt and a round of ammunition in the firearm.

17. The firearm as in claim 13, wherein the magazine retention block comprises a pin hole for receiving a pin, the pin configured to couple a trigger assembly to the firearm.

18. The firearm as in claim 13, further comprising a forward sight, wherein the forward sight is removably coupled to the barrel, and wherein the forward sight comprises two forward sight set screws that couple to the barrel, the forward sight set screws being configured to adjust a position of the forward sight to account for windage.

19. The firearm as in claim 13, wherein the firearm is a semi-automatic tilting-bolt rifle.

20. A firearm, comprising:

a barrel associated with a first firearm model and having a front end and a first barrel nut engaging portion at a rear end;

a magazine;

a magazine retention block comprising a top surface, a tapered portion that tapers towards a bottom of the magazine retention block, a front surface having a groove, a magazine catch, and a magazine catch release;

a gas block;

a gas tube;

a gas piston;

a barrel nut having a threaded portion;

a charging handle;

a receiver associated with the first firearm model and comprising a magazine holder for engaging the magazine; and a trunnion comprising:

an outer surface defined by a front face, a rear face, a top, a bottom, a right side, and a left side;

a bore extending longitudinally from the front face to the rear face and configured to hold a bolt and a portion of a bolt carrier;

a second barrel nut engaging portion disposed at a front end of the bore and comprising screw threads for receiving the threaded portion of the barrel nut;

a curved platform disposed on the top of the trunnion and configured to receive the gas piston;

a slot disposed on the top of the trunnion behind the curved platform, the bolt carrier extending above the slot and coupling to the gas piston above the trunnion;

an ejector cutout for ejecting spent ammunition cartridges, the ejector cutout disposed on one of the left side or right side of the trunnion;

an opening in the bottom of the trunnion for receiving ammunition from the magazine into the trunnion; and a bolt block comprising a set screw for adjusting a position of the bolt block;

wherein the outer surface of the trunnion on each of the left side and the right side comprises a conical depression, two parallel vertically oriented elongated recesses disposed towards the front face of the trunnion and extending upwardly from the bottom of the trunnion, and a horizontally oriented elongated recess disposed behind the two vertically oriented elongated recesses and above the conical depression, the horizontally oriented elongated recess extending forwardly from the rear face of the trunnion;

wherein the second barrel nut engaging portion removably mates with the barrel nut;

wherein the barrel nut removably mates with the barrel;

wherein the firearm is configured to substitute at least one of the barrel, the barrel nut, the gas block, the magazine, and the gas tube with a component from a second firearm model; and wherein adjustment of the set screw configures the firearm for use with a plurality of types of ammunition.

* * * * *